US010351373B2

(12) United States Patent
Hosokawa et al.

(10) Patent No.: US 10,351,373 B2
(45) Date of Patent: Jul. 16, 2019

(54) CONVEYANCE GUIDE, MEDIUM STORAGE BOX, AND MEDIUM TRANSACTION DEVICE

(71) Applicant: Oki Electric Industry Co., Ltd., Tokyo (JP)

(72) Inventors: Kazuhiro Hosokawa, Tokyo (JP); Masaaki Okamoto, Tokyo (JP); Yoshitoshi Takefushi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/570,663

(22) PCT Filed: Apr. 5, 2016

(86) PCT No.: PCT/JP2016/061142

§ 371 (c)(1),
(2) Date: Oct. 30, 2017

(87) PCT Pub. No.: WO2016/194466

PCT Pub. Date: Dec. 8, 2016

(65) Prior Publication Data

US 2018/0290849 A1 Oct. 11, 2018

(30) Foreign Application Priority Data

May 29, 2015 (JP) ..... 2015-110264

(51) Int. Cl.
*B65H 5/38* (2006.01)
*G07D 9/00* (2006.01)
(Continued)

(52) U.S. Cl.
CPC ..... *B65H 5/38* (2013.01); *B65H 5/062* (2013.01); *G07D 9/00* (2013.01); *G07F 19/202* (2013.01);
(Continued)

(58) Field of Classification Search
CPC ..... B65H 5/38; B65H 5/062; G07F 19/205
See application file for complete search history.

(56) References Cited

U.S. PATENT DOCUMENTS 7,900,916 B2 * 3/2011 Sugahara ..... B65H 29/52 271/207
8,939,449 B2 * 1/2015 Takada ..... B65H 5/26 271/264
(Continued)

FOREIGN PATENT DOCUMENTS

JP 2000-318873 A 11/2000
JP 2001-118115 A 4/2001
(Continued)

*Primary Examiner* — Michael C McCullough
(74) *Attorney, Agent, or Firm* — Rabin & Berdo, P.C.

(57) ABSTRACT

In a banknote pay-in/pay-out device (10) of an ATM (1), respective pawl portions (42) are provided at upper ends of a front storage box conveyance guide (32) and a rear storage box conveyance guide (33) provided to a front storage box conveyance guide (32) of a banknote storage box (26). In each pawl portion (42), plural pawl bodies (43) are discretely disposed along a left-right direction. In each pawl body (43), a guide plate (51) looking onto a conveyance space (34) is connected to an upper end of a main body (41), a facing plate (52) is connected to an upper-side edge of the guide plate (51), and a left-side plate (53) and a right-side plate (54) are respectively connected to the left and right edges of the guide plate (51). This increases the strength of the guide plates (51) of the pawl bodies (43) such that damage to the pawl bodies (43) as a result of collisions with other members or the like can be prevented, and enables banknotes to be guided smoothly in the banknote pay-in/pay-out device (10).

9 Claims, 13 Drawing Sheets

(51) Int. Cl.
*B65H 5/06* (2006.01)
*G07F 19/00* (2006.01)

(52) U.S. Cl.
CPC .... *G07F 19/203* (2013.01); *B65H 2701/1912* (2013.01)

(56) References Cited

U.S. PATENT DOCUMENTS

2013/0307210 A1* 11/2013 Takada ..... B65H 5/26
271/3.19
2016/0167906 A1 6/2016 Sato et al.

FOREIGN PATENT DOCUMENTS

JP 2013-242608 A 12/2013
WO WO-2015/040897 A1 3/2015

* cited by examiner

CONVEYANCE GUIDE, MEDIUM STORAGE BOX, AND MEDIUM TRANSACTION DEVICE

TECHNICAL FIELD

The present invention relates to a conveyance guide, a medium storage box, and a medium transaction device, and is suitably applied, for example, to an automatic teller machine (ATM) that is inserted with a medium, such as banknotes, by a customer and performs a desired transaction.

BACKGROUND ART

ATMs and the like, for example into which a customer pays in cash such as banknotes and coins, and that pay out cash to a customer according to the content of a transaction with the customer, are widely employed in financial institutions and the like.

A proposal for such an ATM includes, for example, a banknote pay-in/pay-out port that exchanges banknotes with a customer, a conveyance section that conveys banknotes along a conveyance path, a classification section that classifies the inserted banknotes by denomination and authenticity, a temporary holding section that temporarily holds inserted banknotes, and banknote storage boxes that store banknotes by denomination.

In such an ATM, during a pay-in transaction, when banknotes are inserted into the banknote pay-in/pay-out port by a customer, the inserted banknotes are conveyed along the conveyance path by the conveyance section and classified by the classification section, and then banknotes classified as normal banknotes are stored in the temporary holding section, and banknotes classified as being unsuitable for transaction are placed back in the banknote pay-in/pay-out port and returned to the customer. The ATM then confirms the amount to be deposited by the customer, and then feeds out and conveys the banknotes stored in the temporary holding section such that the denominations thereof are classified once again by the classification section and the banknotes are stored in the respective banknote storage boxes according to their classified denominations.

Conveyance guides that guide banknotes are provided to the conveyance section and the like of the ATM. A flat face or a curved face running along a conveyance path configures a guide face formed in the conveyance guide. The guide face restricts the range of movement of the banknotes so as to cause the banknotes to progress along the conveyance path.

With some ATMs, the efficiency of an operation to replenish banknotes in a banknote storage box or an operation to collect banknotes from a banknote storage box, etc., is increased by attachment/detachment of the banknote storage box to/from a casing. In such ATMs, conveyance guides are provided to a conveyance section of the casing and inside the banknote storage box. When the banknote storage box is mounted to the casing, it is desirable that the two conveyance guides are precisely connected together so as to smoothly connect the respective guide faces to one another.

Further, some ATMs are provided with pawl portions at leading ends of the conveyance guides at both the side of the conveyance section of the casing and the side of the banknote storage box. Plural pawl bodies are discretely disposed in the pawl portions, along a width direction that runs orthogonal to a conveyance direction that is parallel to a guide face. In these ATMs, when a banknote storage box is mounted to the casing, respective pawl portions of complementary conveyance guides interlock each other so as to connect the guide faces together as smoothly as possible (for example, see Japanese Patent Application Laid-Open (JP-A) No. 2013-242608 (FIG. 4)).

SUMMARY OF INVENTION

Technical Problem

In order to smoothly connect the guide faces together, in the pawl portions of the conveyance guides described above, it is desirable that the width direction lengths of the respective pawl bodies be made as short as possible and that a large number of pawl bodies be mutually interlocked. However, shortening each pawl body in the pawl portions along the width direction reduces the strength of each individual pawl body.

Further, when a banknote storage box is mounted to the casing, since it is necessary to mutually connect the banknote storage box together with the conveyance guide of the conveyance section, pawl portions at a leading end portion of the conveyance guide of the banknote storage box are exposed to the outside. Thus, in cases in which the banknote storage box collides with a foreign body in a state removed from the casing, there is concern that the pawl portions of the conveyance guide may be damaged.

In consideration of the above circumstances, the present invention proposes a conveyance guide, a medium storage box, and a medium transaction device in which the strength of a pawl portion provided to a connection portion with another conveyance guide is increased.

Solution to Problem

In order to address the above issue, a conveyance guide of the present invention includes a conveyance guide main body and a pawl portion. The conveyance guide main body restricts a range of movement of a medium using a guide face so as to cause the medium to progress along a conveyance direction parallel to the guide face, and that performs a handover of the medium with a handover counterparty. The pawl portion is disposed at a location on the conveyance guide main body facing the handover counterparty, and is provided with plural pawl bodies projecting out toward the handover counterparty at discrete locations along a width direction intersecting the conveyance direction parallel to the guide face. The pawl bodies each include a guide plate, a facing plate, and two side plates. At least a portion of the guide plate forms the guide face. The facing plate is provided at a non-guiding side of the guide plate, this being an opposite side of the guide plate to the guide face, and is connected to an edge of the guide plate at a handover counterparty side of the guide plate so as to face the handover counterparty. The two side plates are provided at the non-guiding side of the guide plate and are each connected to respective width direction edges of the guide plate and the facing plate and to the conveyance guide main body.

Moreover, a medium storage box of the present invention includes a storage casing, a conveyance guide main body, and a pawl portion. The storage casing internally stores a medium. The conveyance guide main body is provided to the storage casing and restricts a range of movement of the medium using a guide face so as to cause the medium to progress along a conveyance direction parallel to the guide face, and performs a handover of the medium with a handover counterparty. The pawl portion is disposed at a location on the conveyance guide main body facing the handover counterparty, and is provided with plural pawl bodies projecting out toward the handover counterparty at discrete locations along a width direction intersecting the conveyance direction parallel to the guide face. The pawl bodies each include a guide plate, a facing plate, and two side plates. At least a portion of the guide plate forms the guide face. The facing plate is provided at a non-guiding side of the guide plate, this being an opposite side of the guide plate to the guide face, and is connected to an edge of the guide plate at a handover counterparty side of the guide plate so as to face the handover counterparty. The two side plates are provided at the non-guiding side of the guide plate and are each connected to respective width direction edges of the guide plate and the facing plate and to the conveyance guide main body.

Furthermore, a medium transaction device of the present invention includes a casing, a medium storage box, and a handover section. The medium storage box stores a medium transacted with a user, and attaches to and detaches from the casing. The handover section performs a handover of the medium with the medium storage box when the medium storage box is mounted to the casing. The medium storage box includes a storage casing, a conveyance guide main body, and a pawl portion. The storage casing internally stores the medium. The conveyance guide main body is provided to the storage casing and restricts a range of movement of the medium using a storage box guide face so as to cause the medium to progress along a conveyance direction parallel to the storage box guide face. The pawl portion is provided at a facing edge of the conveyance guide main body facing the handover section and that is provided with plural pawl bodies projecting out toward the handover section at discrete locations along a width direction intersecting the conveyance direction parallel to the storage box guide face. The handover section includes a handover guide main body and a handover pawl portion. The handover guide main body restricts a range of movement of the medium using a handover section guide face contiguous to the storage box guide face of the medium storage box so as to cause the medium to progress along a handover direction parallel to the handover section guide face. The handover pawl portion is provided at a handover facing side of the handover guide main body facing the medium storage box and that is provided with plural handover pawl bodies projecting out toward the medium storage box at locations interlocking with the pawl bodies provided to the pawl portion of the medium storage box. The pawl bodies of the medium storage box each include a guide plate, a facing plate, and two side plates. At least a portion of the guide plate forms the storage box guide face. The facing plate is provided at a non-guiding side of the guide plate, this being an opposite side of the guide plate to the storage box guide face, and is connected to an edge of the guide plate on the handover section side of the guide plate so as to face the handover pawl portion. The two side plates are provided at the non-guiding side of the guide plate and are each connected to respective width direction edges of the guide plate and the facing plate and to the conveyance guide main body.

Accordingly, the edge of the guide plate at a handover counterparty side of the guide face, and both width direction side edges of the guide plate are can be configured as ridges where connected to other members such as the facing plate. This thereby enables a marked increase in the strength in comparison to cases in which the edges of the guide plate are not connected to anything.

Advantageous Effects of the Invention

The present invention is able to realize a conveyance guide, a medium storage box, and a medium transaction device in which the strength of a pawl portion provided at a connection portion with another conveyance guide is increased.

DESCRIPTION OF EMBODIMENTS

Explanation follows regarding embodiments for implementing the invention (referred to below as exemplary embodiments), with reference to the drawings.

1. First Exemplary Embodiment

1-1. ATM and Banknote Pay-In/Pay-Out Device Configuration

Figure 1:
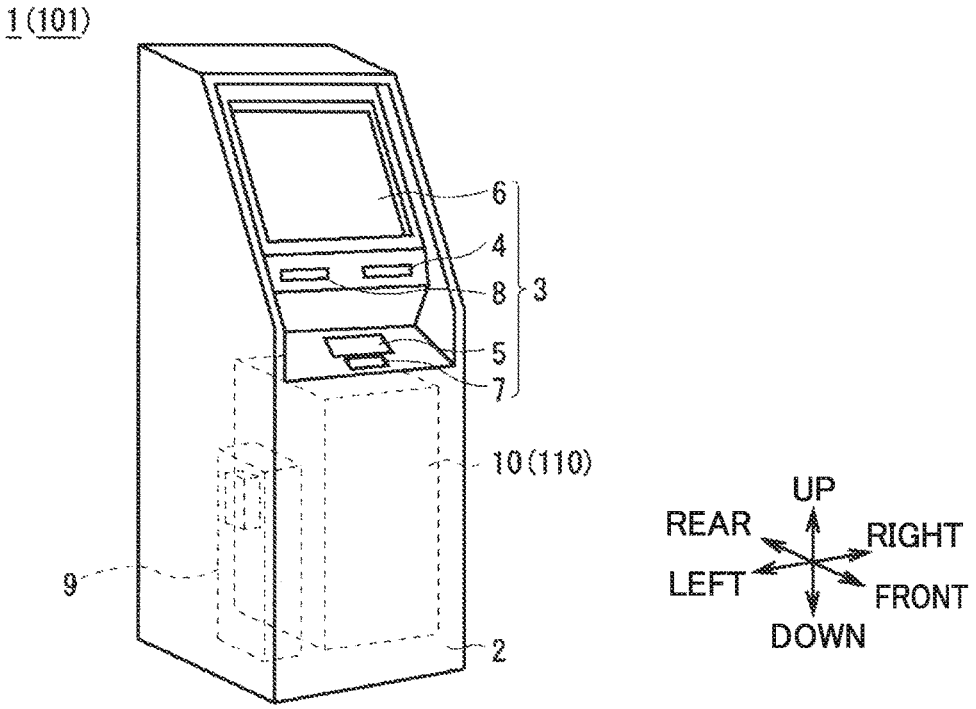
FIG. 1 is a schematic perspective view illustrating configuration of an ATM.

As illustrated in the external view of FIG. 1, an ATM 1 is configured around a box shaped casing 2, and is installed, for example, in a financial institution to perform cash transactions such as pay-in transactions and pay-out transactions with a user (namely, a customer of the financial institution or the like).

The casing 2 is provided with a customer interface 3 at a location enabling easy banknote insertion, easy operation of a touch panel, and the like by a customer facing the front side of the casing 2. The customer interface 3 is provided with a card insertion/removal port 4, a pay-in/pay-out port 5, an operation and display section 6, a ten-key 7, and a receipt issue port 8. The customer interface 3 directly handles cash and passbook transactions with the customer, for example, and notifies transaction-related information and receives operation instructions.

The card insertion/removal port 4 is a section for insertion and return of various cards, such as cash cards. A card processor (not illustrated in the drawings) that reads, for example, account numbers magnetically recorded on the various cards is provided inside the casing of the card insertion/removal port 4. The pay-in/pay-out port 5 is a section into which banknotes for paying in are inserted by a customer, and where banknotes for paying out to a customer are dispensed. The pay-in/pay-out port 5 is moreover opened up, or closed off, by driving a shutter.

The operation and display section 6 is a touch panel integrating a liquid-crystal display (LCD) that displays operation screens during transactions, and a touch sensor that is input with, for example, a transaction type selection, a PIN, or a transaction amount. The ten-key 7 is a physical keypad that is input with, for example, the numbers 0 to 9. The ten-key 7 is employed during PIN and transaction amount input operations and the like. The receipt issue port 8 is a section that issues a receipt printed with transaction details and the like at the end of transaction processing. A receipt processor (not illustrated in the drawings) that prints transaction details and the like on a receipt is provided at the back of the receipt issue port 8.

In the following explanation, the front side is defined as the side of the ATM 1 that a customer faces, and the opposite side thereto is defined as the rear side. The left side, right side, upper side and lower side are respectively defined from the perspective of the left and right as seen by a customer facing the front side.

A main controller 9 that performs general control of the overall ATM 1, a banknote pay-in/pay-out device 10 that performs various processing relating to banknotes, and the like, are provided inside the casing 2. The main controller 9 is configured around a central processing unit (CPU), not illustrated in the drawings. The main controller 9 reads and executes predetermined programs from read only memory (ROM), flash memory, or the like, not illustrated in the drawings, to perform various processing such as pay-in processing and pay-out processing. The main controller 9 includes an internal storage section configured by Random Access Memory (RAM), a hard disk drive, flash memory, or the like. The storage section is stored with various information.

Figure 2:
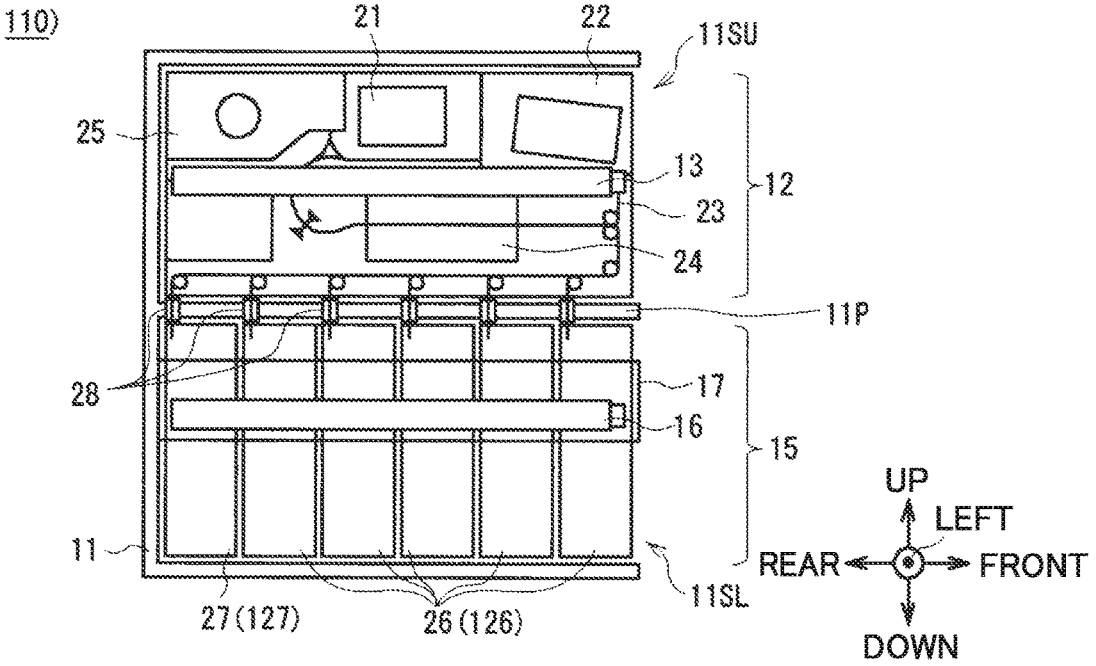
FIG. 2 is a schematic diagram illustrating configuration of a banknote pay-in/pay-out device.

As illustrated in side view in FIG. 2, the banknote pay-in/pay-out device 10 is incorporated with plural sections for performing various processing related to banknotes, serving as a medium, inside a casing 11 configured in a hollow cuboidal shape. The front side of the casing 11 is open, and a partitioning portion 11P provided at substantially the up-down direction center of the casing 11 partitions the inside of the casing 11 into an upper space 11SU on the upper side and a lower space 11SL on the lower side. The upper space 11SU and the lower space 11SL respectively house an upper unit 12 and a lower unit 15.

The upper unit 12 is provided with a banknote controller 21 that performs general control of the overall upper unit 12, a pay-in/pay-out section 22 that exchanges banknotes with a customer, a conveyance section 23 that conveys banknotes to the various sections, a classification section 24 that classifies banknotes, and a temporary holding section 25 that temporarily stores banknotes.

The banknote controller 21 is configured around a CPU, not illustrated in the drawings, similarly to the main controller 9. The banknote controller 21 reads and executes predetermined programs from ROM, flash memory, or the like, not illustrated in the drawings, to perform various processing such as processing to determine the conveyance destination of banknotes and processing to control operation of the various sections. The banknote controller 21 includes an internal storage section configured by RAM, flash memory, or the like. The storage section is stored with various information.

The pay-in/pay-out section 22 is positioned at an upper front portion inside the upper unit 12. The pay-in/pay-out section 22 separates banknotes received from a customer one note at a time and passes the banknotes to the conveyance section 23. The pay-in/pay-out section 22 also stacks banknotes conveyed from the conveyance section 23 and allows a user to take out the banknotes. Conveyance guides that guide banknotes, several rotating rollers and moving belts, and the like are disposed as appropriate in the conveyance section 23, thereby forming a conveyance path (shown by solid lines in the drawings) for conveying banknotes. The conveyance section 23 conveys banknotes along the conveyance path by rotating the each of the rollers as appropriate and moving each of the respective belts as appropriate. The conveyance section 23 positions the long edges of banknotes at a leading end and at a trailing end in the direction of progress so as to convey the banknotes in a direction along their short edges.

The classification section 24 is disposed along the conveyance path of the banknotes. Sensors of plural types are incorporated inside the classification section 24 in order to identify the denomination, authenticity, condition (whether or not damage is present), and the like of the conveyed banknotes. Identification results are sent to the banknote controller 21. The temporary holding section 25 employs what is known as a tape escrow method, and stores banknotes by wrapping the banknotes against a circumferential side face of a circular cylinder shaped drum together with a tape, and feeds out the banknotes by peeling the tape away from the circumferential side face.

Plural banknote storage boxes 26 and a reject storage box 27 that store banknotes are provided in the lower unit 15. The banknote storage boxes 26 are all similarly configured, and each includes an internal space for stacking and storing banknotes. The banknote storage boxes 26 internally stack and store banknotes that have been determined to have a light degree of damage and to be suitable for re-use by the classification section 24 and the banknote controller 21, and that have been conveyed by the conveyance section 23 according to their denomination. On receipt of an instruction to feed out banknotes from the banknote controller 21, the banknote storage boxes 26 separate and feed out the stacked banknotes one note at a time, and pass the banknotes to the conveyance section 23.

The reject storage box 27 likewise includes an internal space for stacking and storing banknotes. The reject storage box 27 internally stores banknotes that have been determined to have a heavy degree of damage and to be unsuitable for re-use (referred to as reject banknotes) by the classification section 24 and the banknote controller 21, and that have been conveyed by the conveyance section 23.

Plural handover sections 28 are also disposed along the front-rear direction between the upper unit 12 and the lower unit 15 in the casing 11, namely at the partitioning portion 11P. Each of the handover sections 28, which serve as handover counterparties, includes a handover guide (described in detail later) for guiding banknotes. The handover sections 28 guide the passage of banknotes during handover of banknotes between the conveyance section 23 and the banknote storage boxes 26 or the reject storage box 27.

In cases in which, for example, a customer performs a pay-in transaction with the ATM 1, in coordination with the main controller 9 and the like, after receiving predetermined operation input from the operation and display section 6, the banknote controller 21 opens the shutter of the pay-in/pay-out port 5 (FIG. 1) to allow insertion of banknotes into the pay-in/pay-out section 22. When banknotes have been inserted, the pay-in/pay-out section 22 shuts the shutter of the pay-in/pay-out port 5, and then separates the banknotes one note at a time and passes the banknotes to the conveyance section 23. The conveyance section 23 conveys the received banknotes to the classification section 24 for classification, and the banknote controller 21 is notified of the obtained classification results. The banknote controller 21 decides the conveyance destination of each banknote accordingly.

When this is performed, the conveyance section 23 conveys banknotes classified by the classification section 24 as normal (referred to as normal notes) to the temporary holding section 25 where they are temporarily held. The conveyance section 23 conveys banknotes classified as unsuitable for transactions (referred to as damaged banknotes, counterfeit banknotes, or the like) to the pay-in/pay-out section 22 for returning to the customer.

The banknote controller 21 then prompts the customer to confirm the pay-in amount using the operation and display section 6 (FIG. 1), and conveys the banknotes held in the temporary holding section 25 to the classification section 24 where the banknotes are classified by denomination, degree of damage, and the like, and acquires the classification results. The banknote controller 21 then has banknotes with a heavy degree of damage conveyed to the reject storage box 27 via the respective handover section 28 to be stored as reject banknotes that are unsuitable for re-use. The banknote controller 21 also has banknotes with a light degree of damage conveyed to the banknote storage boxes 26 of the corresponding denominations via the respective handover section 28 to be stored as banknotes suitable for re-use.

On the other hand, in cases in which, for example, a customer performs a pay-out transaction with the ATM 1, in coordination with the main controller 9 and the like, after receiving predetermined operation input from the operation and display section 6 (FIG. 1), the banknote controller 21 feeds out banknotes from the banknote storage boxes 26 according to the amount to be paid out. The banknote controller 21 passes the banknotes via the respective handover section 28 to the conveyance section 23, and uses the conveyance section 23 to convey the banknotes to the classification section 24 for classification, before conveying the banknotes to the pay-in/pay-out section 22 and opening the shutter of pay-in/pay-out port 5 (FIG. 1) to allow the customer to take out the banknotes.

The front side of the casing 2 of the ATM 1 is configured by a door that can be opened and closed. Opening the door enables access to the banknote pay-in/pay-out device 10 from the outside. The upper unit 12 and the lower unit 15 described above are respectively attached to the casing 11 of the banknote pay-in/pay-out device 10 through slide rails 13 and 16.

Figure 3A:
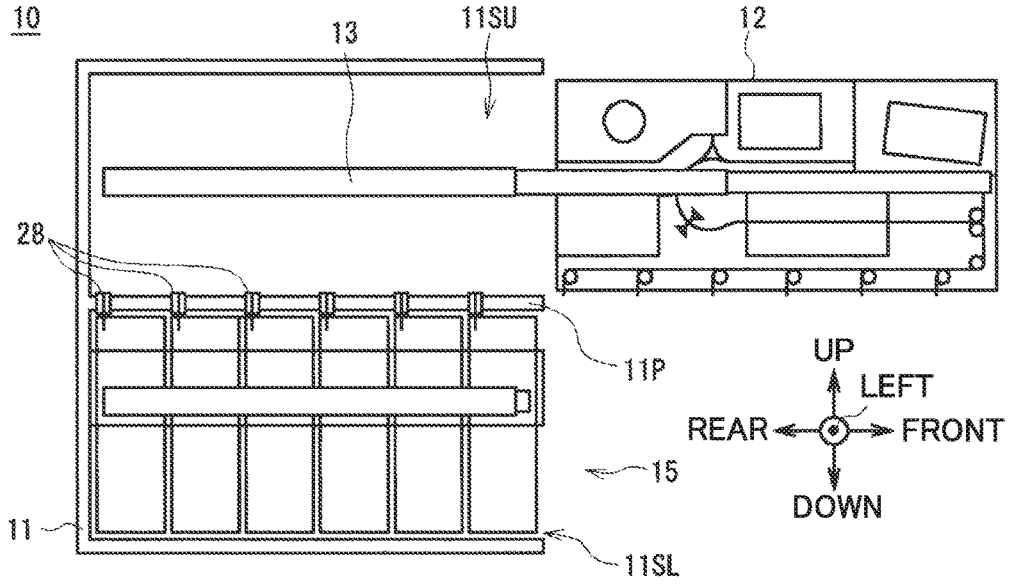
FIG. 3A is a schematic diagram illustrating sliding of an upper unit and a lower unit of a banknote pay-in/pay-out device.

Thus, in a state in which the door of the casing 2 has been opened, the banknote pay-in/pay-out device 10 is able to transition between a state in which the upper unit 12 is housed inside the upper space 11SU of the casing 11 as illustrated in FIG. 2 and a state in which the upper unit 12 is pulled out to the front side of the casing 11 as illustrated in FIG. 3A by moving the upper unit 12 along the front-rear direction while causing the slide rails 13 to extend or retract.

Figure 3B:
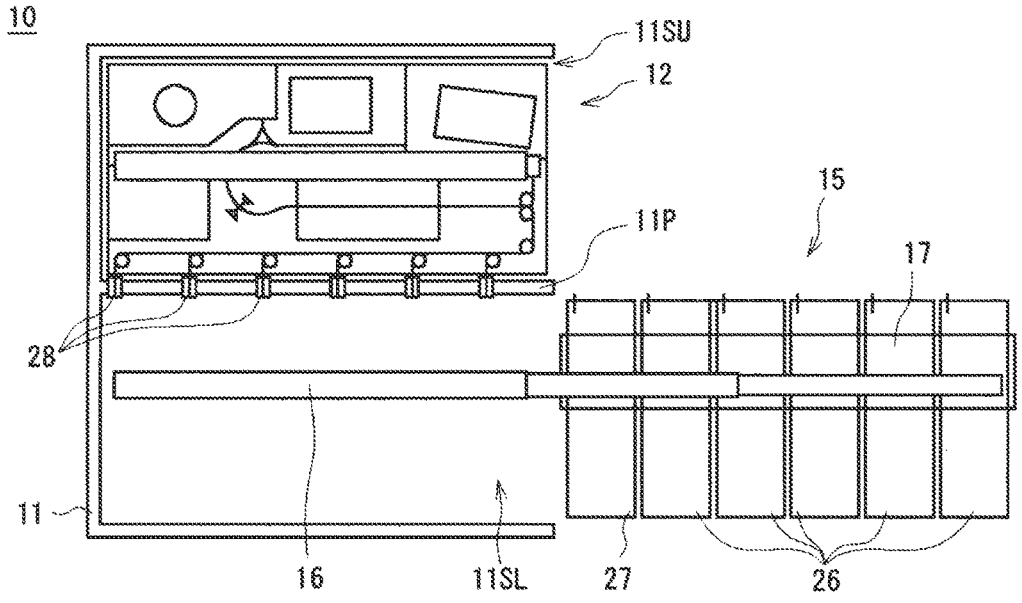
FIG. 3B is a schematic diagram illustrating sliding of an upper unit and a lower unit of a banknote pay-in/pay-out device.

Similarly, the banknote pay-in/pay-out device 10 is able to transition between a state in which the lower unit 15 is housed inside the lower space 11SL of the casing 11 as illustrated in FIG. 2 and a state in which the lower unit 15 is pulled out to the front side of the casing 11 as illustrated in FIG. 3B by moving the lower unit 15 along the front-rear direction while causing the slide rails 16 to extend or retract.

Figure 4:
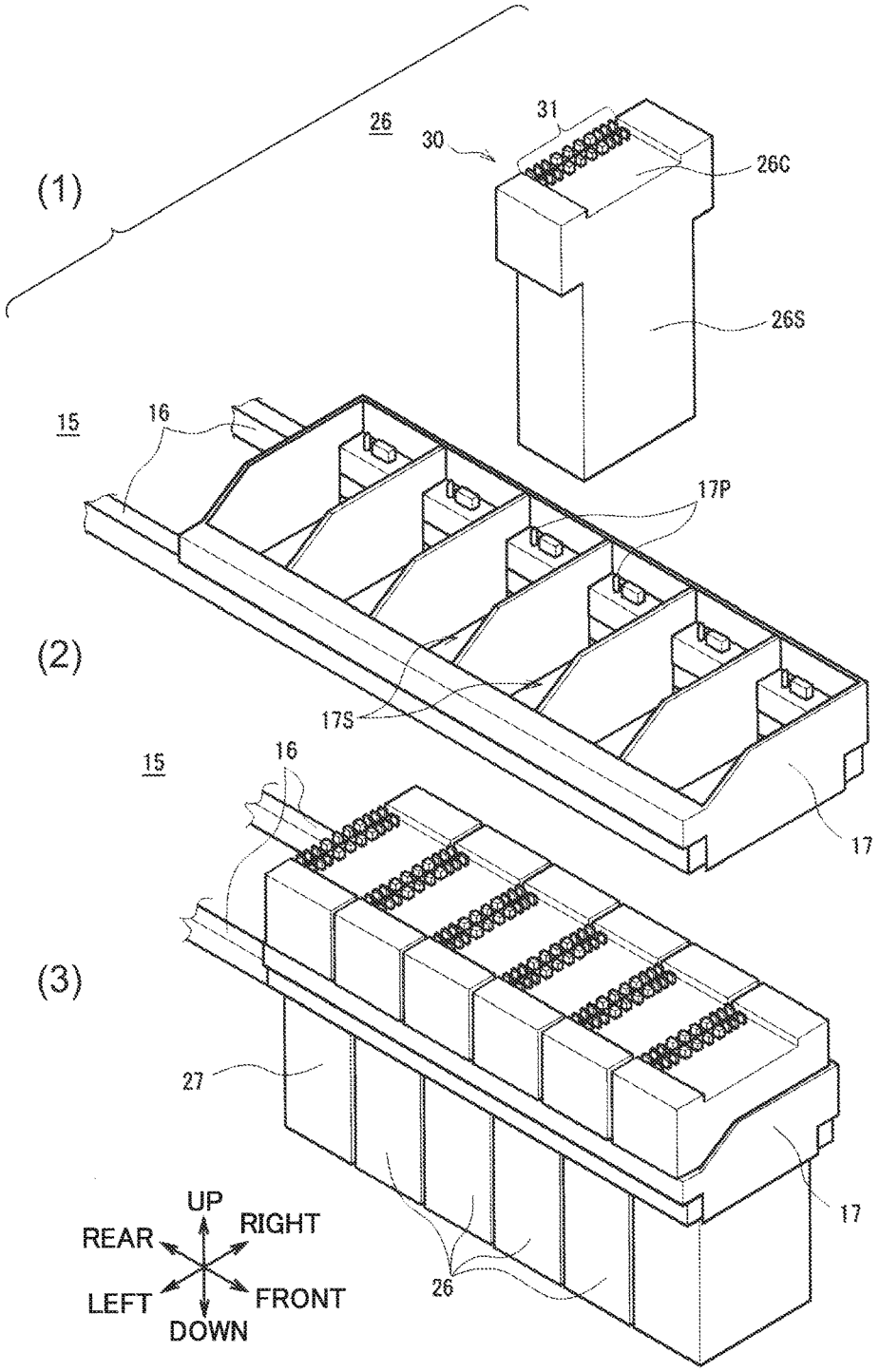
FIG. 4 is a schematic diagram illustrating configuration of a lower unit and a lower frame.

Further, in the lower unit 15, plural slots 17S are disposed in a row along the front-rear direction in a lower frame 17 attached to the slide rails 16 as illustrated in FIG. 4(1). Each slot 17S is configured by a rectangular shaped hole penetrating in the up-down direction. A portion that supports a respective banknote storage box 26 or reject storage box 27 is formed at both the left and right sides of each slot 17S.

As illustrated in FIG. 4(2), although overall formed in cuboidal shapes elongated in the up-down direction, the left-right direction length of an upper-side portion of each banknote storage box 26 extends beyond that of a respective lower-side portion such that the banknote storage boxes 26 are configured in letter T shapes as viewed along the front-rear direction. Note that the reject storage box 27 has the same outward appearance as the banknote storage boxes 26.

This enables the banknote storage boxes 26 to be loaded into the slots 17S of the lower unit 15 as illustrated in FIG. 4(3) by lowering the banknote storage boxes 26 down from the upper side of the respective slots 17S in a state in which the lower frame 17 has been pulled out to the front of the casing 11.

The banknote storage boxes 26 can also be removed from the slots 17S of the lower unit 15 by lifting the banknote storage boxes 26 up in a state in which the lower frame 17 loaded with the banknote storage boxes 26 has been pulled out to the front of the casing 11. Note that in the lower unit 15, the reject storage box 27 is attached to/detached from a respective slot 17S of the lower frame 17 similarly to the banknote storage boxes 26. In the following, the front-rear direction, this being the direction along which the lower frame 17 moves with respect to the casing 11, is also referred to as an attachment/detachment direction.

Further, when the banknote storage boxes 26 have been loaded into the lower frame 17 and the lower frame 17 is stored inside the casing 11 (FIG. 2), upper faces of the banknote storage boxes 26 face the handover sections 28 provided to the partitioning portion 11P of the casing 11 such that the banknote storage boxes 26 are disposed at respective positions for performing handover of banknotes to and from the handover sections 28. In the following, the position of a banknote storage box 26 at which the upper face of the banknote storage box 26 faces a handover section 28 so as to enable the handover of banknotes therebetween is referred to as a facing position. Further, the up-down direction, this being the direction in which banknotes progress during banknote handover between the banknote storage boxes 26 and the handover sections 28, is also referred to as a conveyance direction.

In this manner, in the banknote pay-in/pay-out device 10, when the banknote storage boxes 26 have been respectively loaded into the slots 17S of the lower frame 17 and the lower frame 17 is stored inside the casing 11, each of the banknote storage boxes 26 is disposed at a respective facing position (FIG. 2) so as to enable banknote handover with the respective handover sections 28 of the casing 11 to be performed.

1-2. Storage Box Guidance Section Configuration

Figure 5:
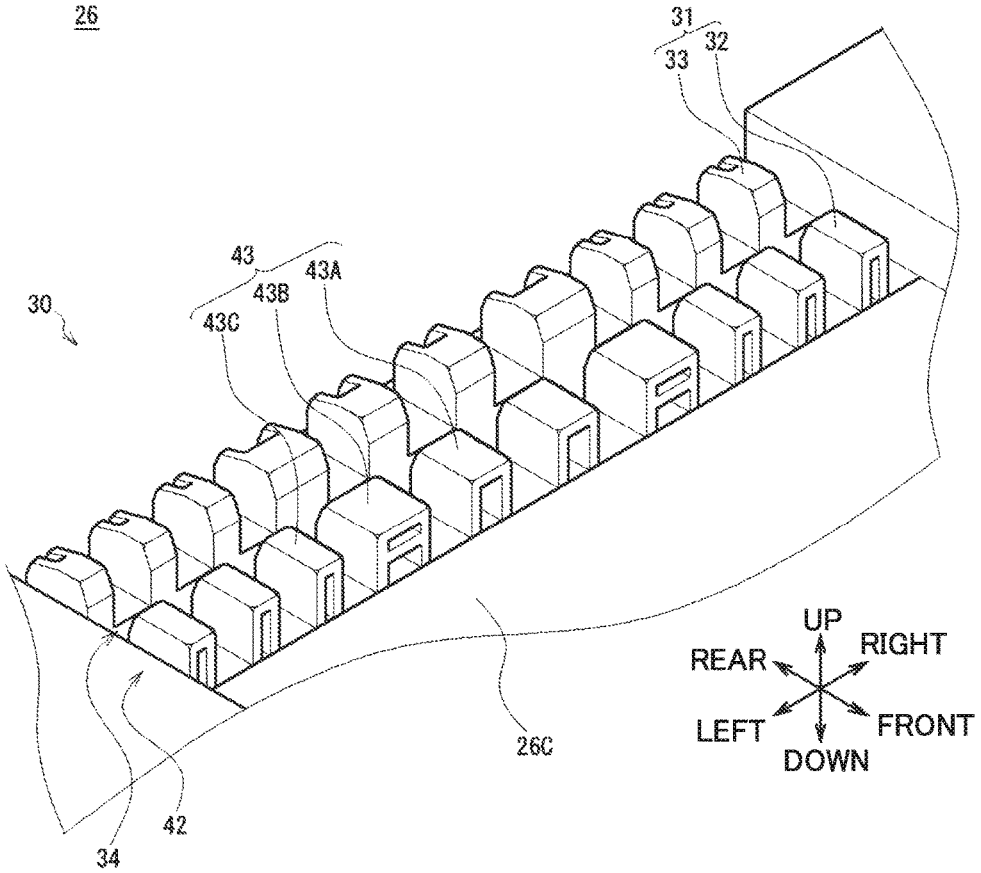
FIG. 5 is a schematic perspective view illustrating configuration of a storage box guidance section according to a first exemplary embodiment.

As illustrated in FIG. 4(1), a storage box guidance section 30 that guides banknotes conveyed to/from a respective handover section 28 is formed at an upper-side portion of a storage box casing 26S of each banknote storage box 26. As illustrated in FIG. 5, in which a portion of FIG. 4(1) is enlarged, the storage box guidance section 30 is provided with a front storage box conveyance guide 32 disposed at a front side and a rear storage box conveyance guide 33 disposed at a rear side. In the following, a rear face of the front storage box conveyance guide 32 and a front face of the rear storage box conveyance guide 33 are respectively referred to as storage box guide faces 32S and 33S. The front storage box conveyance guide 32 and the rear storage box conveyance guide 33 are each configured from a conductive resin material and are manufactured by injecting molding employing a mold that is split into a front and rear by a split line running along the up-down direction.

A conveyance space 34, configured by predetermined spacing (for example, 5 mm), is formed between the front storage box conveyance guide 32 and the rear storage box conveyance guide 33. The conveyance space 34 configures a conveyance path along which banknotes are conveyed along the up-down direction with sheet faces of the banknotes facing the front-rear direction. Driving rollers 36 and following rollers 37 for transmitting drive force to each of the banknotes are incorporated into the front storage box conveyance guide 32 and the rear storage box conveyance guide 33 (described in detail below). For ease of explanation, the front storage box conveyance guide 32 and the rear storage box conveyance guide 33 are also collectively referred to below as a storage box conveyance guide group 31. The surface of a portion at the front side of the storage box conveyance guide group 31 is covered by an upper cover 26C, which covers the vicinity of the upper face of the banknote storage box 26.

Figure 6:
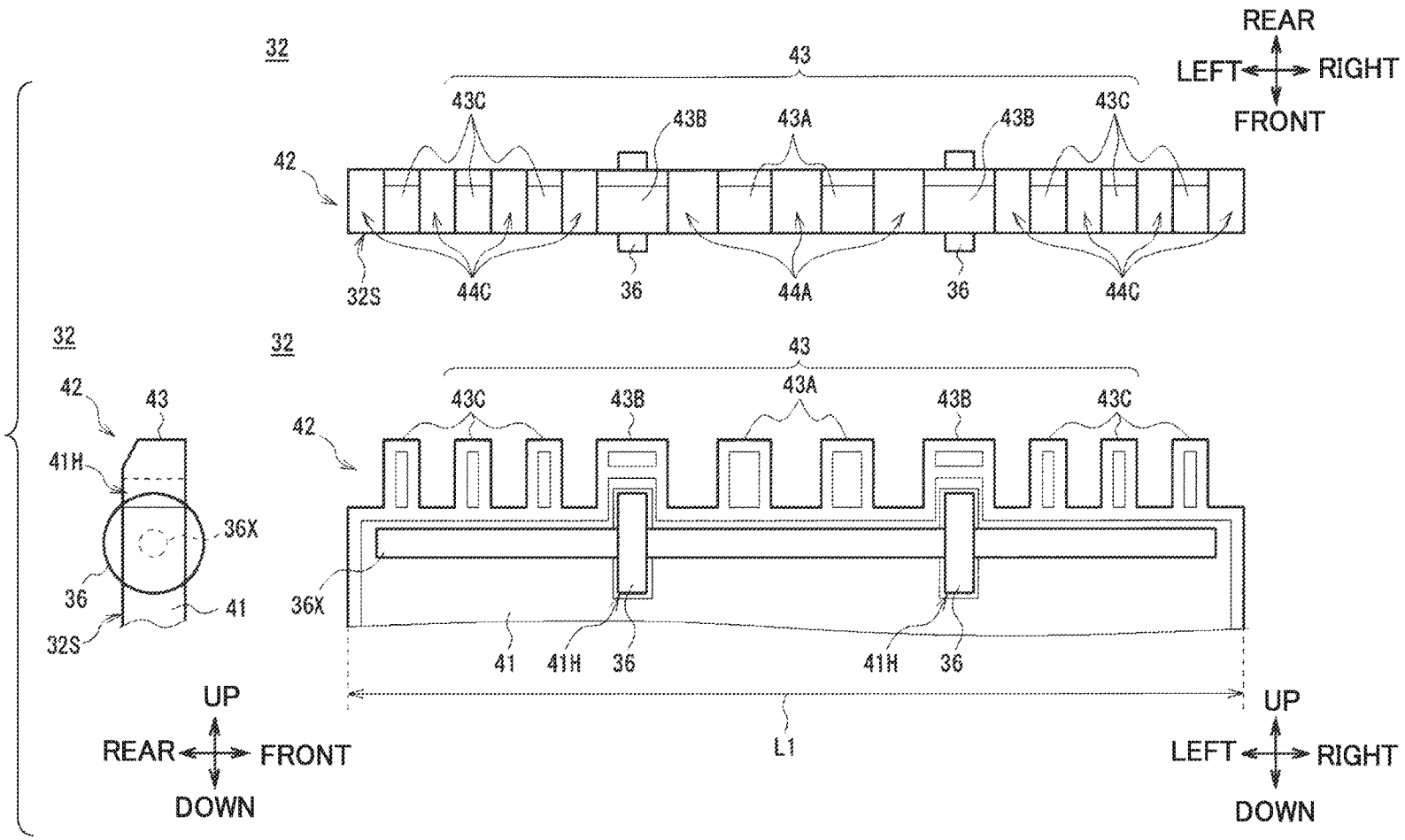
FIG. 6 is a schematic three-plane diagram illustrating configuration of a front storage box conveyance guide.

As illustrated in the schematic three-plane diagram of FIG. 6, a pawl portion 42 is provided to the front storage box conveyance guide 32 at an upper end of a main body 41 that is formed with a flat front face. Plural pawl bodies 43 are discretely disposed along the left-right direction in the pawl portion 42, with inter-pawl body gaps 44 being formed between the pawl bodies 43. Three types of pawl bodies 43A, 43B, and 43C, each with a different left-right direction length, are provided to the pawl portion 42.

Figure 7A:
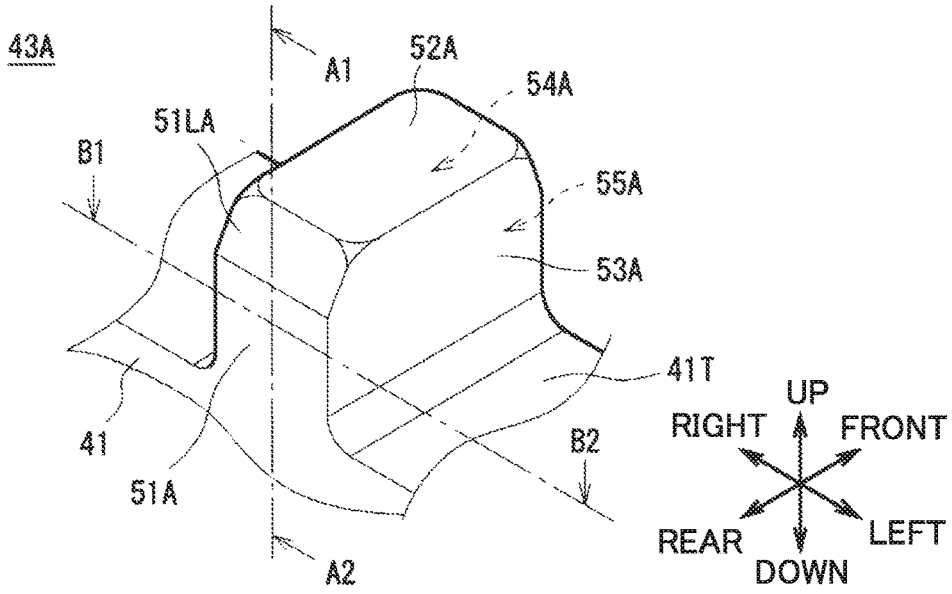
FIG. 7A is a schematic perspective view illustrating configuration of a pawl body.
Figure 7B:
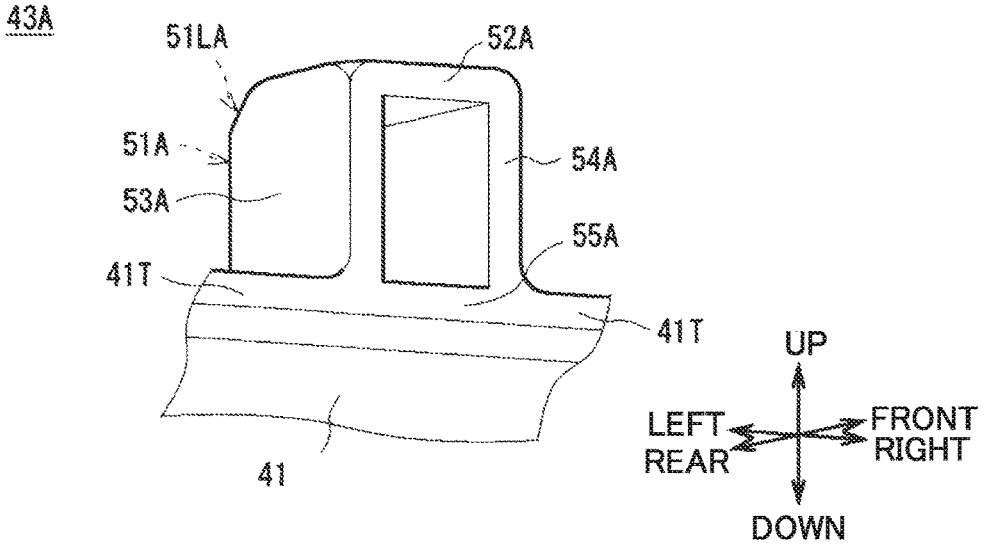
FIG. 7B is a schematic perspective view illustrating configuration of a pawl body.
Figure 8A:
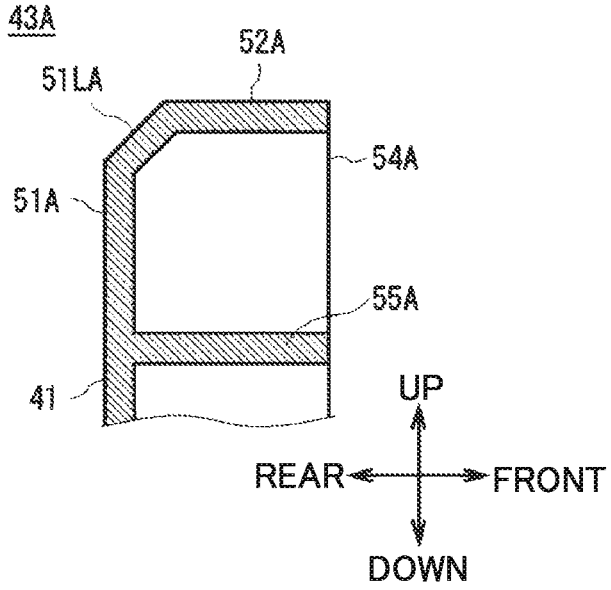
FIG. 8A is a schematic cross-section illustrating configuration of a pawl body.
Figure 8B:
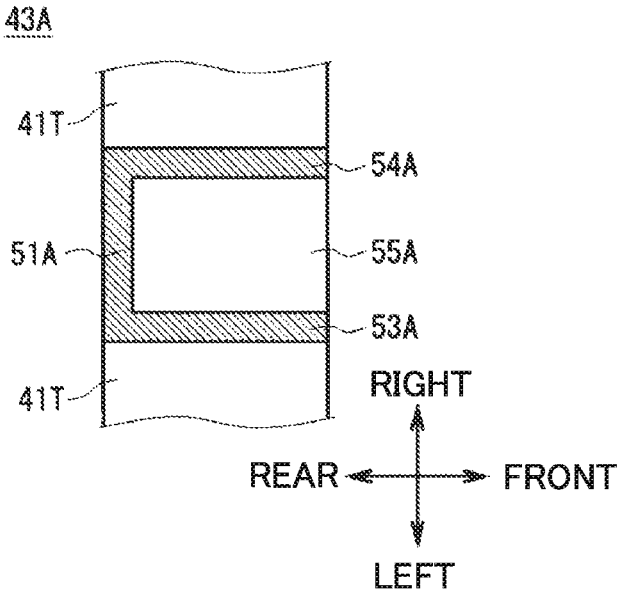
FIG. 8B is a schematic cross-section illustrating configuration of a pawl body.

Two of the pawl bodies 43A are disposed spaced apart from each other by an inter-pawl body gap 44A, configured by predetermined spacing, at substantially the left-right direction center of the pawl portion 42. As illustrated in FIG. 7A, FIG. 7B, FIG. 8A, and FIG. 8B, the pawl bodies 43A are overall formed in hollow cuboidal shapes having open front faces. In other words, the pawl bodies 43 have a shape in which the upper, lower, left, right, and rear sides of each of the pawl bodies 43 are bounded by five plate shaped members. Note that FIG. 8A is a cross-section taken along A1-A2 in FIG. 7A, and FIG. 8B is a cross-section taken along B1-B2 in FIG. 7A.

Each of the pawl bodies 43A is configured by a guide plate 51A positioned at the rear side of the pawl body 43A looking onto the conveyance space 34, a facing plate 52A positioned at the upper side of the pawl body 43A, a left-side plate 53A positioned at the left side of the pawl body 43A, a right-side plate 54A positioned at the right side of the pawl body 43A, and a coupling plate 55A that links the left-side plate 53A and the right-side plate 54A together.

A rear face of the guide plate 51A configures a flat face that is contiguous to a rear face of the main body 41. An inclined face 51LA facing obliquely upward toward the rear is formed in the vicinity of an upper end of the guide plate 51A. An upper-end edge of the inclined face 51LA of the guide plate 51A is connected to a rear-side edge of the facing plate 52A. A rear-side edge of the left-side plate 53A is connected to a left-side edge of the guide plate 51A, an upper-side edge of the left-side plate 53A is connected to a left-side edge of the facing plate 52A, and a lower-side edge of the left-side plate 53A is connected to a main body upper face portion 41T forming an upper face of the main body 41.

The coupling plate 55A is formed in a plate shape that is substantially parallel to the facing plate 52A. Left and right edges of the coupling plate 55A are respectively connected to the vicinity of lower-side edges of the left-side plate 53A and the right-side plate 54A, and a rear-side edge of the coupling plate 55A is connected to the guide plate 51A at the location of connection with the main body 41.

Thus, in each pawl body 43A, each of the upper, lower, left, and right edges of the guide plate 51A is respectively connected to the main body 41, the facing plate 52A, the left-side plate 53A, or the right-side plate 54A. In other words, in each pawl body 43A, the lower-side edge of the guide plate 51A is embedded within the flat face contiguous to the main body 41, and the upper-side edge and both left- and right-side edges of the guide plate 51A configure ridges connected to the facing plate 52A, the left-side plate 53A, or the right-side plate 54A.

Figure 9A:
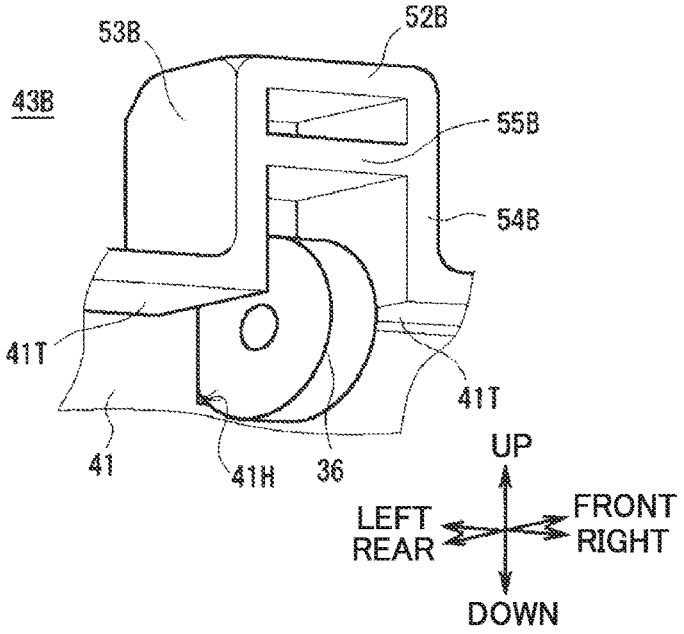
FIG. 9A is a schematic diagram illustrating configuration of a pawl body.
Figure 9B:
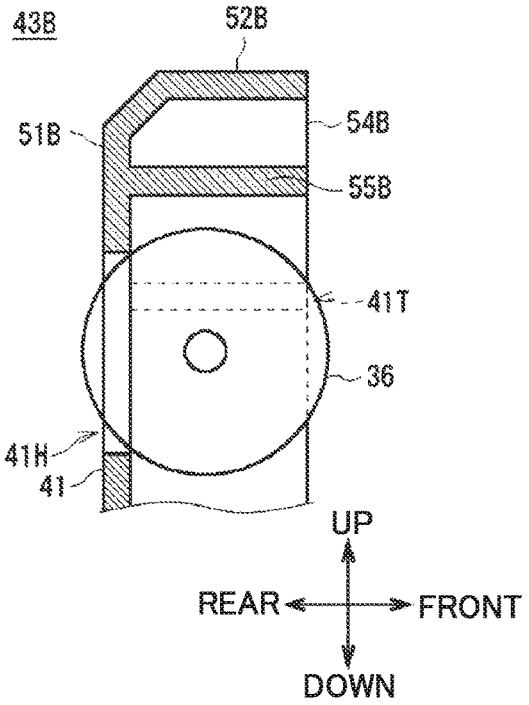
FIG. 9B is a schematic diagram illustrating configuration of a pawl body.

One pawl body 43B is disposed at both the left and right outer sides of the two pawl bodies 43A in the pawl portion 42 (FIG. 6), separated by the inter-pawl body gap 44A. As illustrated in FIG. 9A and FIG. 9B, each of the pawl bodies 43B is configured in a cuboidal shape, which resembles that of the pawl bodies 43A but is more elongated along the left-right direction, by a guide plate 51B, a facing plate 52B, a left-side plate 53B, a right-side plate 54B, and a coupling plate 55B respectively corresponding to the guide plate 51A, the facing plate 52A, the left-side plate 53A, the right-side plate 54A, and the coupling plate 55A of the pawl bodies 43A.

The guide plate 51B and the facing plate 52B are configured as if the guide plate 51A and the facing plate 52A had respectively been lengthened in the left-right direction. An inclined face 51LB is formed at a connection portion between the guide plate 51B and the facing plate 52B. The left-side plate 53B and the right-side plate 54B are configured similarly to the left-side plate 53A and the right-side plate 54A, respectively.

The driving rollers 36 are incorporated almost directly below the pawl bodies 43B of the front storage box conveyance guide 32. The driving rollers 36 are formed in flat circular disk shapes having their central axis oriented along the left-right direction. A rotation shaft 36X penetrates a central portion of each driving roller 36. The rotation shaft 36X is supported at a front side of the rear face of the main body 41 so as to be capable of rotation. When rotational force is transmitted to the rotation shaft 36X through a gear or the like from a motive power source such as a motor, not illustrated, the rotation shaft 36X rotates together with the two driving rollers 36.

Through holes 41H are formed in a rear face portion of the main body 41 at locations corresponding to the driving rollers 36. Each through hole 41H is configured by an angular hole that is elongated in the up-down direction and that penetrates the main body 41 in the front-rear direction. In the front storage box conveyance guide 32, the vicinity of a rear end of each driving roller 36 projects out slightly from the through holes 41H to the rear side of the rear face portion, namely to the conveyance space 34 side of the rear face portion.

In addition, in the front storage box conveyance guide 32, an upper end of each driving roller 36 is positioned at the upper side of the main body upper face portion 41T of the main body 41, namely at the upper side of lower ends of the respective left-side plate 53B and right-side plate 54B. Upper ends of the through holes 41H accordingly reach to the upper side of the lower ends of the guide plates 51B. In other words, each through hole 41H is formed across a range spanning from a front face portion of the main body 41 to the guide plate 51B of the respective pawl body 43B.

In accordance therewith, the left and right edges of each coupling plate 55B are respectively connected to the left-side plate 53B and the right-side plate 54B, and the rear-side edge of each coupling plate 55B is connected to the guide plate 51B at a position higher than the upper end of the driving roller 36, namely, at a location higher than the upper end of the through hole 41H and at the upper side of the lower ends of the left-side plate 53B and the right-side plate 54B. Interference between the coupling plate 55B and the driving roller 36 is thereby avoided.

In addition, three of the pawl bodies 43C are respectively disposed along the left-right direction at both the left and right outer sides of the two pawl bodies 43B in the pawl portion 42 (FIG. 6). The respective pawl bodies 43C are discretely disposed separated from each adjacent pawl body 43B by an inter-pawl body gap 44C and such that adjacent pawl bodies 43C are separated by the inter-pawl body gap 44C.

Each of the pawl bodies 43C is configured in a cuboidal shape, which resembles that of the pawl bodies 43A but is shortened along the left-right direction, by a guide plate 51C, a facing plate 52C, a left-side plate 53C, a right-side plate 54C, and a coupling plate 55C respectively corresponding to the guide plate 51A, the facing plate 52A, the left-side plate 53A, the right-side plate 54A, and the coupling plate 55A of the pawl bodies 43A.

The guide plate 51, facing plate 52, left-side plate 53, right-side plate 54, and coupling plate 55 of each of the pawl bodies 43 thus configure a cuboidal shape open at the front side, the front side being a non-guiding side. Further, the inclined face 51L is formed at a portion connecting the upper end of the guide plate 51 and the facing plate 52. For ease of explanation, in the following, the left-right direction along which the plural pawl bodies 43 are arranged is also referred to as the width direction. The width direction (left-right direction) is a direction intersecting both the attachment/detachment direction (front-rear direction) and the conveyance direction (up-down direction) described above.

The rear storage box conveyance guide 33 is configured with substantial front-rear symmetry to the front storage box conveyance guide 32. The rear storage box conveyance guide 33 is formed with a pawl portion 42 at an upper end of a main body 41. Similarly to the front storage box conveyance guide 32, plural pawl bodies 43 (43A, 43B, 43C) are discretely disposed along the left-right direction in this pawl portion 42. However, as illustrated in FIG. 5, the vicinity of an end portion at a non-guiding side (namely the rear side) at the upper face of each pawl body 43 is rounded in the rear storage box conveyance guide 33. In accordance therewith, the front-rear direction length of the facing plate 52 of each pawl body 43 is shorter than that of the respective facing plate 52 on the front storage box conveyance guide 32 side.

The respective positions and sizes of the pawl bodies 43 in the pawl portions 42 are thusly aligned with each other in the left-right direction and in the up-down direction in the storage box conveyance guide group 31 (the front storage box conveyance guide 32 and the rear storage box conveyance guide 33).

Further, the rear sides of the pawl bodies 43 of the front storage box conveyance guide 32 and the front sides of the pawl bodies 43 of the rear storage box conveyance guide 33, namely the conveyance space 34 sides, are also respectively referred to as guiding sides, and the front sides of the pawl bodies 43 of the front storage box conveyance guide 32 and the rear sides of the pawl bodies 43 of the rear storage box conveyance guide 33, namely the sides opposite to the conveyance space 34, are also respectively referred to as non-guiding sides. Thus, each pawl body 43 is configured in a box shape covered by the five plate shaped members from all directions except for at the non-guiding side, and such that the plate shaped members are connected to each other along their edges.

Note that the rear storage box conveyance guide 33 is provided with the following rollers 37 instead of the driving rollers 36 in the front storage box conveyance guide 32. Drive force from a motive power source such as a motor is not transmitted to the following rollers 37. The following rollers 37 are capable of rotating freely about a rotation shaft 37X (illustrated subsequently in FIG. 11). The following rollers 37 are biased toward the front by a predetermined biasing means (not illustrated). A front end of each following roller 37 abuts a rear end of the respective driving roller 36 inside the conveyance space 34.

In cases in which a banknote has progressed into the conveyance space 34, the banknote is accordingly able to be gripped between the driving rollers 36 and the following rollers 37. In addition, drive force supplied from a motor or the like rotates the driving rollers 36 such that the driving rollers 36 transmit drive force to banknotes gripped between the driving rollers 36 and the following rollers 37 while also causing the following rollers 37 to rotate, enabling progression of the banknotes in the up-down direction.

1-3. Handover Section and Conveyance Section Configuration

Figure 10A:
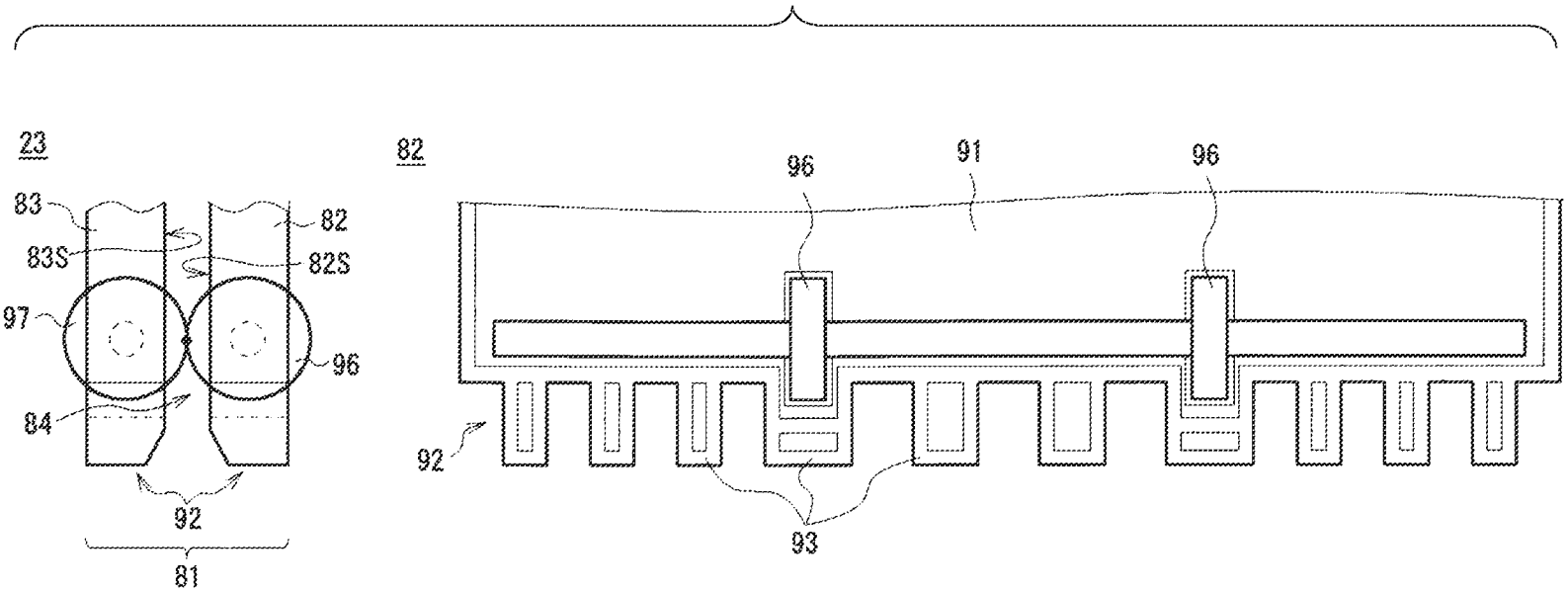
FIG. 10A is a schematic diagram illustrating configuration of a conveyance guide in a handover section and a conveyance section.
Figure 10B:
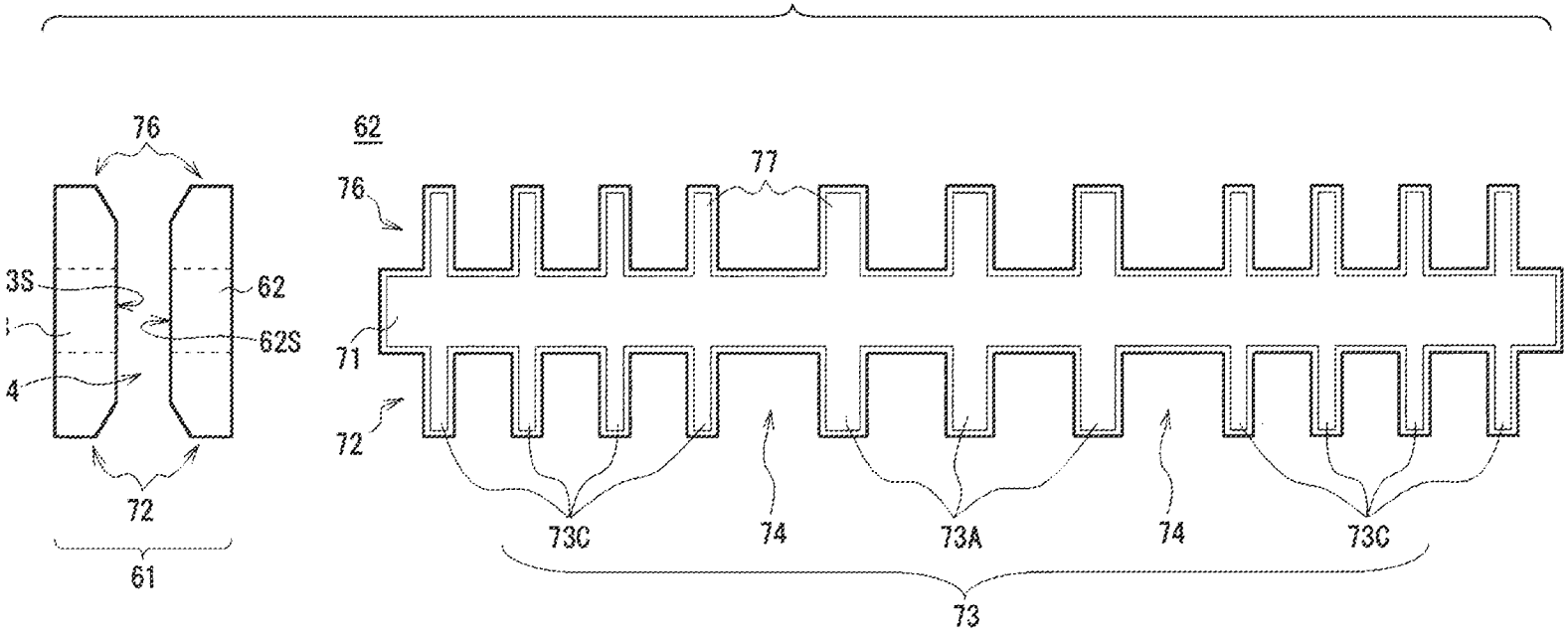
FIG. 10B is a schematic diagram illustrating configuration of a conveyance guide in a handover section and a conveyance section.

As illustrated in FIG. 10B, a front handover section conveyance guide 62 and a rear handover section conveyance guide 63 that respectively correspond to the front storage box conveyance guide 32 and the rear storage box conveyance guide 33 are provided to the handover section 28. For ease of explanation, in the following, the front handover section conveyance guide 62 and the rear handover section conveyance guide 63 are also collectively referred to as a handover section conveyance guide group 61.

A conveyance space 64, configured by predetermined spacing (for example, 5 mm), is formed between the front handover section conveyance guide 62 and the rear handover section conveyance guide 63. Similarly to the conveyance space 34 of the banknote storage boxes 26, the conveyance space 64 configures a conveyance path along which banknotes are conveyed along the up-down direction with sheet faces of the banknotes facing the front-rear direction. The front handover section conveyance guide 62 is configured centered about a cuboidal main body 71 that is thin in the front-rear direction, short in the up-down direction, and long in the left-right direction. A pawl portion 72 is formed at a lower end of the main body 71. Plural pawl bodies 73 are discretely disposed along the left-right direction in the pawl portion 72.

The pawl bodies 73 are configured as if the pawl bodies 43 were inverted in the up-down direction. Each of the pawl bodies 73 is shaped having its upper, lower, left, right, and rear sides bounded by five plate shaped members. In other words, each pawl body 73 is configured bounded by the five plate shaped members from all directions except for at the front side, and such that the plate shaped members are connected to each other along their edges. Inter-pawl body gaps 74 are formed between pawl bodies 73 that are adjacent in the left-right direction.

The left-right direction positions and lengths of the pawl bodies 73 are set so as to complement the positions and lengths of the respective pawl bodies 43 in the front storage box conveyance guide 32 of the banknote storage boxes 26. Namely, the left-right direction positions and lengths of the pawl bodies 73 in the pawl portion 72 of the front handover section conveyance guide 62 respectively correspond to the inter-pawl body gaps 44 of the front storage box conveyance guide 32. The left-right direction positions and lengths of the inter-pawl body gaps 74 in the front handover section conveyance guide 62 also respectively correspond to the pawl bodies 43 in the pawl portion 42 of the front storage box conveyance guide 32.

The rear handover section conveyance guide 63 is configured with substantial front-rear symmetry to the front handover section conveyance guide 62. A pawl portion 72 is also formed to the rear handover section conveyance guide 63 at the lower end of a main body 71. Similarly to the front handover section conveyance guide 62, plural pawl bodies 73 are discretely disposed along the left-right direction in this pawl portion 72 so as to have left-right direction positions and lengths that complement the pawl bodies 43 of the rear storage box conveyance guide 33 of the banknote storage boxes 26. In the following, a rear face of the front handover section conveyance guide 62 and a front face of the rear handover section conveyance guide 63 are respectively also referred to as handover section guide faces 62S and 63S.

The pawl portions 72 are thus provided to the handover section 28, and are formed at a lower end of the handover section conveyance guide group 61, namely at the lower ends of the front handover section conveyance guide 62 and the rear handover section conveyance guide 63, so as to complement the pawl portions 42 of the storage box conveyance guide group 31, and the pawl bodies 73 are thus discretely disposed along the left-right direction in the pawl portions 72.

In addition, pawl portions 76 configured with up-down symmetry to the pawl portions 72 are provided at the upper ends of the main bodies 71 of the front handover section conveyance guide 62 and the rear handover section conveyance guide 63. Each pawl portion 76 is provided with plural pawl bodies 77 configured with shapes having up-down symmetry with the respective pawl bodies 73.

A front conveyance section conveyance guide 82 and a rear conveyance section conveyance guide 83 that configure part of the conveyance section 23 are provided at the upper side of each handover section 28. For ease of explanation, the front conveyance section conveyance guide 82 and the rear conveyance section conveyance guide 83 are also collectively referred to below as conveyance section conveyance guide group 81. A conveyance space 84 for conveying banknotes is formed between the front conveyance section conveyance guide 82 and the rear conveyance section conveyance guide 83. In the following, a rear face of the front conveyance section conveyance guide 82 and a front face of the rear conveyance section conveyance guide 83 are respectively also referred to as conveyance section guide faces 82S and 83S.

A lower-side portion of the front conveyance section conveyance guide 82 is formed having substantial up-down symmetry with an upper-side portion of the front storage box conveyance guide 32. A pawl portion 92 that has up-down symmetry with the pawl portion 42 is provided to the front conveyance section conveyance guide 82 at the lower end of a main body 91 that corresponds to the main body 41. Plural pawl bodies 93 that have up-down symmetry with the respective pawl bodies 43 are disposed along the left-right direction in the pawl portion 92. Two driving rollers 96 respectively corresponding to the two driving rollers 36 are also incorporated into the front conveyance section conveyance guide 82.

A lower-side portion of the rear conveyance section conveyance guide 83 is formed with substantial up-down symmetry to an upper-side portion of the rear storage box conveyance guide 33, namely with substantial front-rear symmetry to the lower-side portion of the front conveyance section conveyance guide 82. A pawl portion 92 that has up-down symmetry with the pawl portion 42 is provided at the lower end of a main body 91 that corresponds to the respective main body 41. Plural pawl bodies 93 that have front-rear symmetry with the respective pawl bodies 93 of the front conveyance section conveyance guide 82 are disposed along the left-right direction in this pawl portion 92. Two following rollers 97 are also incorporated into the rear conveyance section conveyance guide 83 at positions respectively corresponding to those of the two driving rollers 96.

With this configuration, as described above, a banknote storage box 26 is disposed at the facing position in the banknote pay-in/pay-out device 10 by loading the banknote storage box 26 into a slot 17S of the lower frame 17 and storing the lower frame 17 in the lower space 11SL (FIG. 2).

Figure 11:
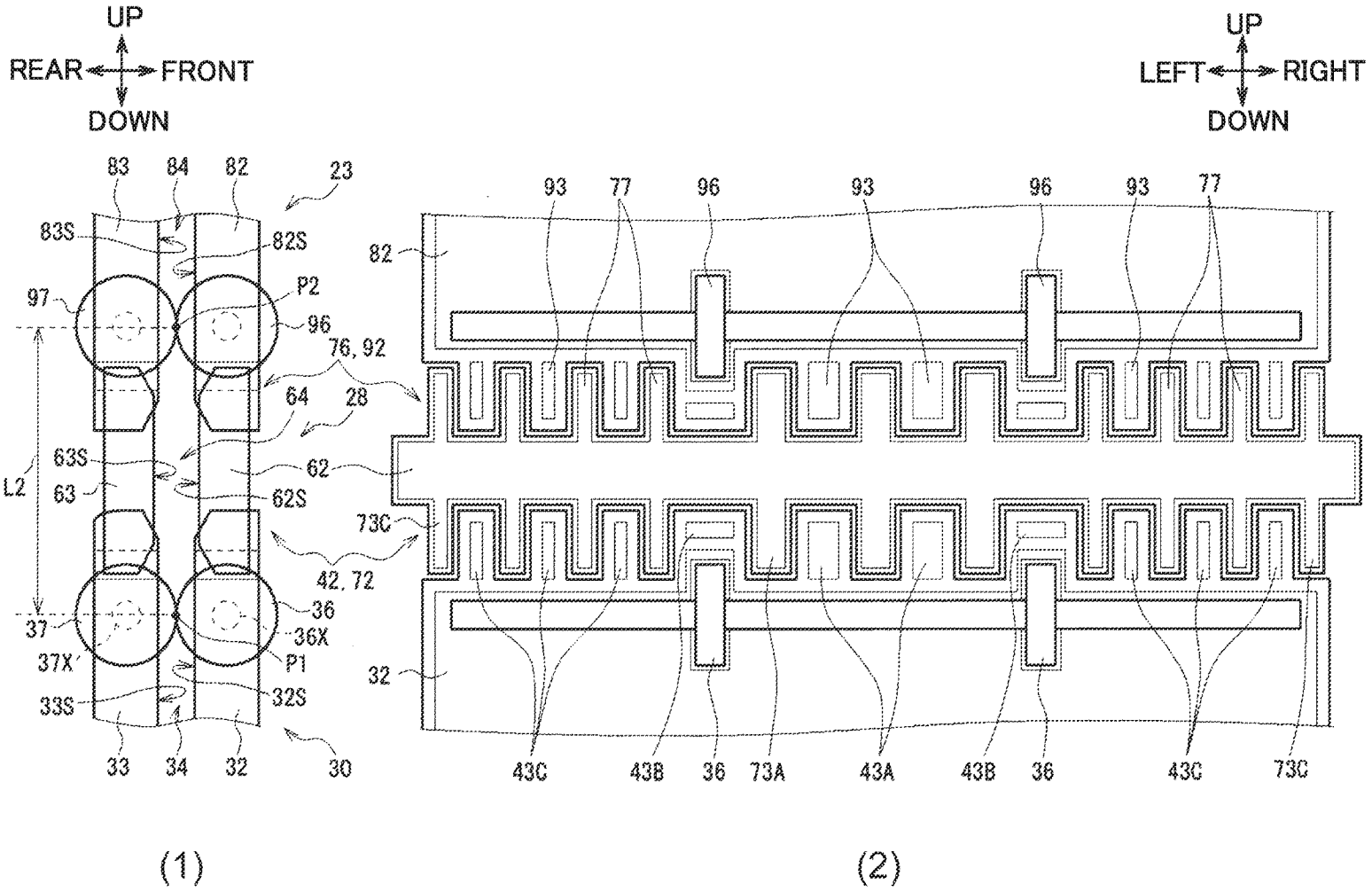
FIG. 11 is a schematic diagram illustrating connections between conveyance guides.

When this is performed, in the banknote pay-in/pay-out device 10, as illustrated in FIG. 11, the pawl portion 42 of the front storage box conveyance guide 32 interlocks with the pawl portion 72 of the front handover section conveyance guide 62 and the pawl portion 42 of the rear storage box conveyance guide 33 interlocks with the pawl portion 72 of the rear handover section conveyance guide 63. In the banknote pay-in/pay-out device 10, the conveyance space 34 on the banknote storage box 26 side and the conveyance space 64 on the handover section 28 side are thereby coupled together in the up-down direction, and the storage box guide faces 32S and 33S are able to be smoothly connected to the handover section guide faces 62S and 63S at the front and rear of the conveyance space 34 and the conveyance space 64.

Further, when the upper unit 12 (FIG. 2 and FIG. 3) is stored inside the upper space 11SU of the casing 11, the pawl portion 76 of the front handover section conveyance guide 62 of the handover section 28 interlocks with the pawl portion 92 of the front conveyance section conveyance guide 82 of the conveyance section 23, and the pawl portion 76 of the rear handover section conveyance guide 63 interlocks with the pawl portion 92 of the rear conveyance section conveyance guide 83 in the banknote pay-in/pay-out device 10. In the banknote pay-in/pay-out device 10, the conveyance space 64 on the handover section 28 side and the conveyance space 84 on the conveyance section 23 side are thereby coupled together in the up-down direction, and the handover section guide faces 62S and 63S are able to be smoothly connected to the conveyance section guide faces 82S and 83S at the front and rear of the conveyance space 64 and the conveyance space 84.

The pawl portions 72 and 76 are thus provided to the upper ends and the lower ends of the front handover section conveyance guide 62 and the rear handover section conveyance guide 63 in the handover section 28, and the pawl portions 92 are thus provided to the lower ends of both the front conveyance section conveyance guide 82 and the rear conveyance section conveyance guide 83 in the conveyance section 23.

1-4. Sizes of Respective Portions in the Pawl Portions

In the front storage box conveyance guide 32, the number and placement of each pawl body 43 provided to the pawl portion 42, and the left-right direction length (also referred to below as the pawl body width) of each pawl body 43, is determined based on plural conditions (referred to below as pawl body conditions).

Figure 12:
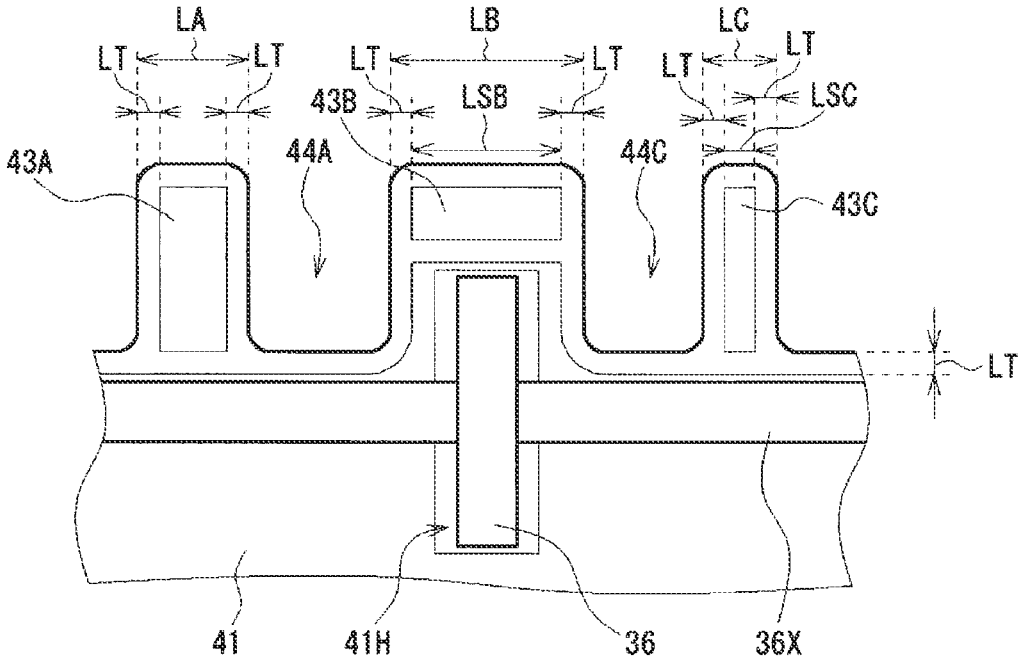
FIG. 12 is a schematic diagram illustrating the dimensions of various parts of a pawl body.

As illustrated in FIG. 12, a thickness LT of each plate shaped member (guide plate 51, facing plate 52, left-side plate 53, right-side plate 54, and coupling plate 55) of the pawl bodies 43 (43A, 43B, and 43C) is determined based on the strength of the resin material, front-rear direction lengths, and the like, of the plate shaped members. The thickness LT is, for example, 1.5 mm.

In the pawl bodies 43C, which have the smallest pawl body width, a length LSC, which is the spacing between the left-side plate 53C and the right-side plate 54C, is 2 mm. The length LSC is a value that is set such that the strength of a mold for manufacturing the front storage box conveyance guide 32 using injection molding is able to be maintained. The result of this is that the smallest value for the pawl body width of the pawl bodies 43 in the pawl portion 42 is 5 mm. The smallest value for the pawl body width of the pawl bodies 73 in the pawl portion 72 of the front handover section conveyance guide 62 interlocking with the pawl portion 42 is also 5 mm. In practice, a length LC representing the pawl body width of the pawl bodies 43C is 5 mm, the smallest value.

In each of the pawl bodies 43B, the upper end of each driving roller 36 and the vicinity thereof is interposed between the left-side plate 53B and the right-side plate 54B. The left-right direction length of the driving rollers 36 is set such that the value thereof is as short as possible while still transmitting sufficient drive force to banknotes. The left-right direction length of the through holes 41H through which the rear ends of the driving rollers 36 project out toward the conveyance space 34 side is longer than the left-right direction length of the driving rollers 36 so as to avoid contact between the rotating driving rollers 36 and the main body 41. Namely, there are gaps respectively formed between the main body 41 and the left and right of the driving rollers 36.

For such reasons, in the pawl bodies 43B, a length LSB, which is the spacing between the left-side plate 53B and the right-side plate 54B, is 10 mm, and a length LB representing the pawl body width is 13 mm. Namely, the pawl body width of the pawl bodies 43B is sufficiently longer than the pawl body width of the pawl bodies 43C.

A conveyance width L1 (FIG. 6), which is the left-right direction length of the front storage box conveyance guide 32, is set so as to be longer than the length of the long edge of the largest banknote handled by the banknote pay-in/pay-out device 10. Further, the left-right direction positions of the driving rollers 36 are determined such drive force is able to be transmitted to the banknote with the smallest long-edge length out of the banknotes handled by the banknote pay-in/pay-out device 10 by both left and right driving rollers 36 and the like, even in a state in which the banknote is being conveyed with the maximum possible left-right direction deviation with respect to the conveyance path.

Namely, after determining the pawl body widths of the pawl bodies 43C and the pawl bodies 43B, first, the pawl bodies 43B are disposed with one being on the left and one being on the right in the pawl portion 42. Then, based on the principle that in the pawl portion 42, as many as possible of the pawl bodies 43 having a pawl body width of 5 mm or greater should be placed between the pawl bodies 43B, and that the inter-pawl body gaps 44A should be formed longer (namely, wider) than the pawl bodies 73A on the front handover section conveyance guide 62 side, two of the pawl bodies 43A are disposed between the pawl bodies 43B. A length LA, which is the pawl body width of the pawl bodies 43A, is longer than the length LC, which is the pawl body width of the pawl bodies 43C.

Further, with a view to providing as many pawl bodies 43 as possible in the pawl portion 42, three of the pawl bodies 43C are respectively disposed at outer side of each of the left and right pawl bodies 43B, namely at the opposite sides to the pawl bodies 43A. At this time, in the pawl portion 42, the length of the inter-pawl body gaps 44C, which is the spacing between pawl bodies 43C, is set to a length enabling insertion of the pawl bodies 73C, which have an equal pawl body width to that of the pawl bodies 43C.

Note that in the banknote pay-in/pay-out device 10, the lower frame 17 to which the banknote storage boxes 26 are mounted slides in the front-rear direction with respect to the casing 11, and when this occurs the pawl portion 42 of the front storage box conveyance guide 32 slides in the front-rear direction with respect to the pawl portion 72 of the front handover section conveyance guide 62. Thus, in the banknote pay-in/pay-out device 10, configuration is such that in the left-right direction, gaps are formed between the pawl bodies 43 and pawl bodies 73 that interlock with each other. Specifically, the lengths of the inter-pawl body gaps 44 (44A and 44C) are values in which gaps large enough to avoid collisions during movement in the front-rear direction are respectively added to the pawl body widths of the opposing pawl bodies 73 (73A and 73C).

Thus, in the pawl portion 42 of the front storage box conveyance guide 32, the smallest value of the pawl body widths is determined based on the strength of the plate shaped members configuring the pawl bodies 43 and on the strength of the mold. After the driving rollers 36 have been disposed at positions able to convey banknotes deviated along the left-right direction in the conveyance path, as many pawl bodies 43 as possible are disposed in the pawl portion 42. This results in two of the pawl bodies 43A being disposed at the center of the pawl portion 42, one of the pawl bodies 43B being disposed at both left and right outer sides of the pawl bodies 43A, and three of the pawl bodies 43C being disposed at an outer side of each of the pawl bodies 43B (FIG. 6).

1-5 Operation and Advantageous Effects

In the configuration described above, the storage box guidance section 30 that guides banknotes handed over to or from a handover section 28 is provided at an upper-side portion of each banknote storage box 26 in the banknote pay-in/pay-out device 10 of the ATM 1 according to the first exemplary embodiment. The pawl portions 42, in which plural of the pawl bodies 43 are discretely disposed along the left-right direction, are respectively provided at the upper end of the storage box conveyance guide group 31 of the storage box guidance section 30, namely at the upper ends of the front storage box conveyance guide 32 and the rear storage box conveyance guide 33 (FIG. 5).

In each of the pawl bodies 43, the guide plate 51 looking onto the conveyance space 34 is connected to the upper end of the main body 41, the upper-side edge of the guide plate 51 is connected to the facing plate 52, and the left and right edges of the guide plate 51 are respectively connected to the left-side plate 53 and the right-side plate 54 (FIG. 7A, FIG. 7B, FIG. 8A, and FIG. 8B). Namely, in each pawl body 43, the edges at each of the upper, lower, left, and right positions of the guide plate 51 are respectively connected to another plate shaped member.

Generally, in cases in which a banknote storage box 26 provided with plate shaped members like the guide plates 51 is carried, edge portions of the plate shaped members, rather than central portions of the plate faces thereof, are most likely to collide with other members. Namely, supposing that the respective edges of the guide plate 51 were not connected to the facing plate 52 and the like, there is a possibility that damage such as cracking or chipping would occur as a result of a collision with another member or the like. In cases in which such damage has occurred, there is a possibility that the guide plates 51 would be unable to suitably guide banknotes due to banknotes being guided through the conveyance space 34 catching on the guide plates 51, for example.

Regarding this point, in each of the pawl bodies 43 according to the present exemplary embodiment, each of the upper, lower, left, and right edges of the guide plate 51 is connected to another member (FIG. 7A, FIG. 7B, FIG. 8A, and FIG. 8B), thereby markedly increasing the strength in the vicinity of the edges of the guide plate 51 and enabling the likelihood of damage due to a collision or the like to be greatly reduced. Namely, the pawl bodies 43 enable banknotes conveyed through the conveyance space 34 to progress smoothly along the up-down direction.

Note that in each of the pawl bodies 43, edges at non-guiding sides (for example, the front sides) of the facing plate 52, the left-side plate 53, and the right-side plate 54 are not connected to other members, and so similarly to the case described above, there is a possibility that damage will occur at these edges. However, in the pawl bodies 43, the edges at the non-guiding sides are sufficiently removed from the guide plate 51, and so even if these edges were to be damaged, the possibility that the damage would extend to the guide plate 51 is extremely low. Namely, in each of the pawl bodies 43, permitting damage to non-guiding sides of the facing plate 52, the left-side plate 53, and the right-side plate 54 in a collision with another member may actually enable damage to the guide plate 51 to be avoided.

Moreover, in each of the pawl bodies 43, the coupling plate 55 is connected to the guide plate 51, the left-side plate 53, and the right-side plate 54 (FIG. 7A, FIG. 7B, FIG. 8A, and FIG. 8B). This enables the strength of the pawl bodies 43 to be increased and the likelihood of damage to be reduced compared to cases in which the coupling plate 55 is omitted from the pawl bodies 43.

Note that in the banknote pay-in/pay-out device 10, the portion of the casing 11 enclosing the lower unit 15 is a safe casing configured by comparatively thick metal plates. This safe casing is provided for the purpose of protecting, from the outside, the banknote storage boxes 26 and the reject storage box 27, in which large amounts of banknotes are stored. In cases in which holes are provided between the inside and the outside, it is desirable that the number of such holes be as small as possible and that the holes be as small as possible. Accordingly, although each handover section 28 is provided with the front handover section conveyance guide 62 and the rear handover section conveyance guide 63 at the inside of a hole penetrating the safe casing in the up-down direction, driving rollers 36 like those in the front storage box conveyance guide 32 are not provided.

Accordingly, when a banknote storage box 26 performs banknote handover with the conveyance section 23 through a handover section 28, the vicinity of the upper end of the banknote needs to be gripped by the driving rollers 96 and the following rollers 97 on the conveyance section 23 side while the vicinity of the lower end of the banknote is being gripped by the driving rollers 36 and the following rollers 37. In other words, in the banknote pay-in/pay-out device 10, as illustrated in FIG. 11, a gripping point spacing L2, this being the spacing between a gripping point P1 where a banknote is gripped by the driving rollers 36 and the following rollers 37 on the banknote storage box 26 side and a gripping point P2 where the banknote is gripped by the driving rollers 96 and the following rollers 97 on the conveyance section 23 side, needs to be kept shorter than the length of the short edge of the smallest banknote handled.

Further, in the banknote pay-in/pay-out device 10, configuring the length of the respective pawl bodies 43 and the like so as to be somewhat lengthy along the conveyance direction enables the likelihood of a step being formed at the connection locations between the storage box guide faces 32S and 33S and the handover section guide faces 62S and 63S when the pawl portions 42 interlock with the pawl portions 72 to be reduced, enabling a smooth connection therebetween (FIG. 11).

Note that in the pawl portions 42 of the front storage box conveyance guide 32 and the rear storage box conveyance guide 33, inserting the upper ends the driving rollers 36, the following rollers 37, and the vicinities thereof into the pawl bodies 43B achieves a reduction of the gripping point spacing L2 while still ensuring pawl portion 42 length along the conveyance direction.

From another perspective, in the pawl portions 42, ideally the pawl body widths of the pawl bodies 43 are kept short so as to provide as many pawl bodies 43 as possible, thereby enabling the storage box guide faces 32S and 33S to be more smoothly connected to the handover section guide faces 62S and 63S when interlocking with the pawl portions 72 of the front handover section conveyance guide 62 and the like. However, in practice, in the pawl portions 42, the pawl body width of the pawl bodies 43B is wider than that of the pawl bodies 43C so as to allow the upper ends of the driving rollers 36, the following rollers 37, and the vicinities thereof to be inserted into the pawl bodies 43B, thereby enabling reduction of gripping point spacing L2 so as to increase the precision of banknote handover with the conveyance section 23 even while purposely decreasing the number of the pawl bodies 43 able to be installed thereto.

Further, in the banknote pay-in/pay-out device 10, the pawl bodies 73 in the pawl portions 72 and the pawl bodies 77 in the pawl portions 76 respectively provided in the handover section conveyance guide group 61 of the handover section 28, and the pawl bodies 93 in the pawl portions 92 respectively provided in the conveyance section conveyance guide group 81 of the conveyance section 23, are all configured similarly to the pawl bodies 43 in the pawl portions 42. Accordingly, in the banknote pay-in/pay-out device 10, the strength of the respective pawl bodies at the guiding sides thereof is increased, preventing damage, and enabling banknotes to be guided smoothly.

According to the above configuration, in the banknote pay-in/pay-out device 10 of the ATM 1, the pawl portions 42 are respectively provided at the upper ends of the front storage box conveyance guide 32 and the rear storage box conveyance guide 33 provided to the storage box guidance section 30 of each banknote storage box 26, and in each pawl portion 42, plural of the pawl bodies 43 are discretely disposed along the left-right direction. In each of the pawl bodies 43, the guide plate 51 looking onto the conveyance space 34 is connected to the upper end of the main body 41, the upper-side edge of the guide plate 51 is connected to the facing plate 52, and the left and right edges of the guide plate 51 are respectively connected to the left-side plate 53 and the right-side plate 54. In the banknote pay-in/pay-out device 10, the strength of the guide plate 51 in each of the pawl bodies 43 is thereby increased, enabling damage due to a collision with another member or the like to be prevented, and enabling banknotes to be guided smoothly.

2. Second Exemplary Embodiment

An ATM 101 (FIG. 1) according to a second exemplary embodiment differs from the ATM 1 according to the first exemplary embodiment in the point that a banknote pay-in/pay-out device 110 is provided in place of the banknote pay-in/pay-out device 10, and is configured similarly in other respects. The banknote pay-in/pay-out device 110 (FIG. 2) differs from the banknote pay-in/pay-out device 10 in the point that banknote storage boxes 126 and a reject storage box 127 are provided in place of the banknote storage boxes 26 and the reject storage box 27, and is configured similarly in other respects.

Figure 13:
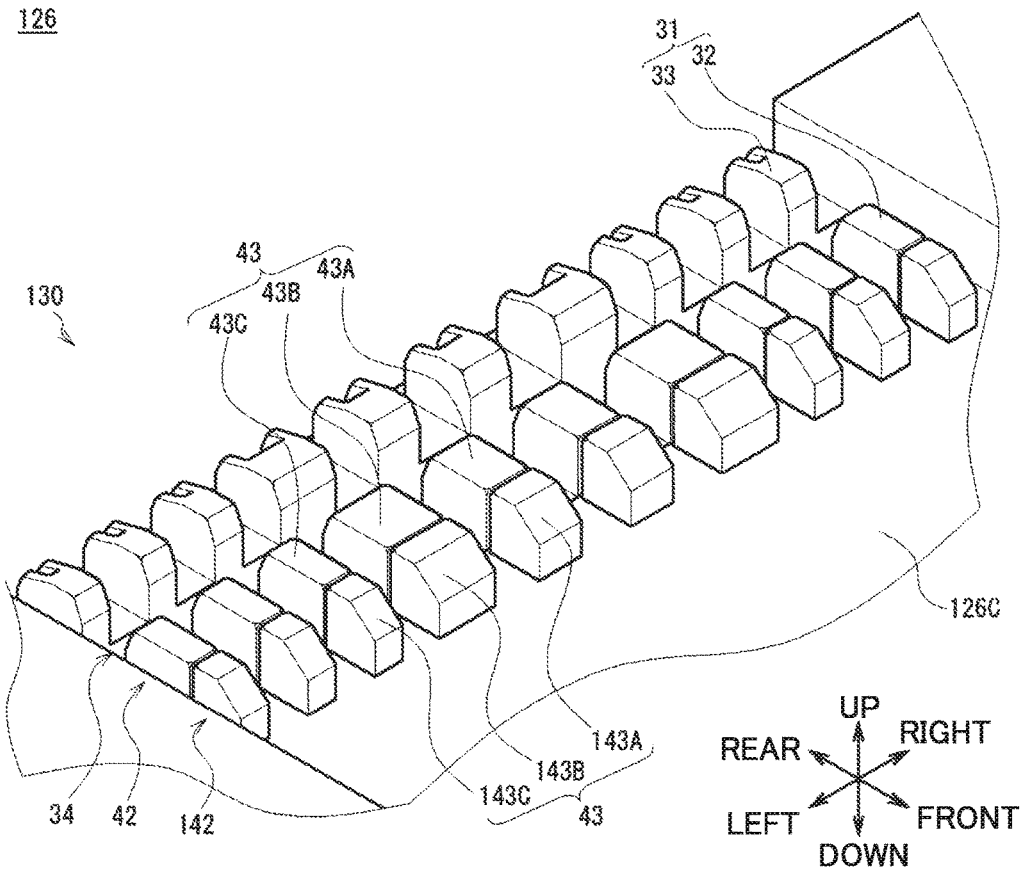
FIG. 13 is a schematic perspective view illustrating internal configuration of a storage box according to a second exemplary embodiment.

As illustrated in FIG. 13, which corresponds to FIG. 5, each banknote storage box 126 differs from the banknote storage boxes 26 in the point that a storage box guidance section 130 is provided in place of the storage box guidance section 30, and is configured similarly in other respects. The storage box guidance section 130 differs from the storage box guidance section 30 in the point that an upper cover 126C is provided in place of the upper cover 26C at the front side of the storage box conveyance guide group 31, and is configured similarly in other respects.

Figure 14:
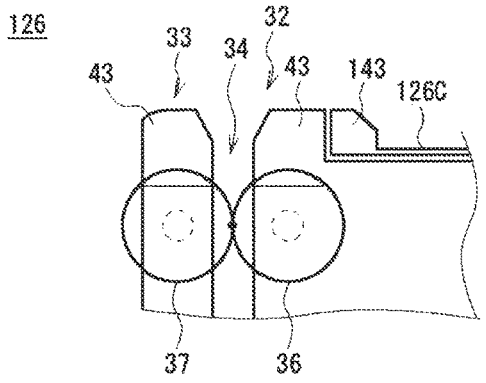
FIG. 14 is a schematic cross-section illustrating internal configuration of a storage box according to the second exemplary embodiment.

As illustrated in FIG. 14, the upper cover 126C, which serves as casing protection section, differs from the upper cover 26C in the point that it includes a protective pawl portion 142 at a rear-end portion on its upper face, namely at a portion positioned directly in front of the front storage box conveyance guide 32. Protective pawl bodies 143 (143A, 143B, and 143C) are disposed in the protective pawl portion 142 at locations directly in front of the respective pawl bodies 43 (43A, 43B, and 43C) in the pawl portion 42.

Each of the protective pawl bodies 143A, 143B, and 143C is formed in a cuboidal shape, and left-right direction lengths and upper face positions of the protective pawl bodies 143A, 143B, and 143C are aligned so as to be equal to those of the pawl bodies 43A, 43B, and 43C, respectively. Each of the protective pawl bodies 143A, 143B, and 143C has a shape in which a range encompassing ridge lines at the front upper-side is cut away obliquely. Note that similarly to the banknote storage boxes 126, the reject storage box 127 also includes a storage box guidance section 130.

Thus configured, the banknote storage box 126 enables the front side of the respective pawl bodies 43 in the pawl portion 42 of the front storage box conveyance guide 32 to be protected by the protective pawl bodies 143 in the protective pawl portion 142. For example, the banknote storage box 126 enables a configuration to be achieved in which another member about to collide with the pawl bodies 43 in the pawl portion 42 from the front side can be caused to collide beforehand with the protective pawl bodies 143 in the protective pawl portion 142.

In such a case, in the banknote storage box 126, although there is a possibility that the protective pawl bodies 143 will be damaged, the likelihood of damage to the pawl bodies 43 is able to be greatly reduced compared to the first exemplary embodiment. Moreover, in the banknote storage box 126, even supposing the protective pawl bodies 143 in the protective pawl portion 142 were to be damaged, the progress of banknotes is not affected so long as the pawl bodies 43 in the pawl portion 42 are not damaged, enabling smooth handover of banknotes with the handover section 28.

Further, in the banknote storage box 126, the left-right direction positions of the respective protective pawl bodies 143 in the protective pawl portion 142 are aligned with the respective pawl bodies 43 in the pawl portion 42, and the left-right direction lengths of the protective pawl bodies 143 are aligned so as to be equal to those of the corresponding pawl bodies 43. Accordingly, when the banknote storage box 126 is mounted in the lower frame 17 and moved along the front-rear direction, the banknote storage box 126 is able to progress smoothly without colliding with the respective pawl bodies 73 in the respective pawl portions 72 of the handover section conveyance guide group 61 (FIG. 10A, FIG. 10B, and FIG. 11) of the handover section 28.

According to the above configuration, in the banknote pay-in/pay-out device 110 of the ATM 101 according to the second exemplary embodiment, the pawl portions 42 are respectively provided at the upper ends of the front storage box conveyance guide 32 and the rear storage box conveyance guide 33 provided to the storage box guidance section 130 of each banknote storage box 126, and in each pawl portion 42, plural of the pawl bodies 43 are discretely disposed along the left-right direction. Further, each banknote storage box 126 is provided with the protective pawl portion 142 at an upper-face rear-end portion of the upper cover 126C, and the protective pawl bodies 143 are respectively disposed at locations corresponding to the pawl bodies 43. In the banknote pay-in/pay-out device 110, the protective pawl bodies 143 are able to effectively protect the pawl bodies 43, enabling damage to the pawl bodies 43 due to a collision with another member or the like to be prevented, and enabling banknotes to be guided smoothly.

3. Other Exemplary Embodiments

Note that in the first exemplary embodiment above, explanation was given regarding a case in which the left and right edges of the coupling plate 55A of each pawl body 43A are respectively connected to the vicinity of lower ends of the left-side plate 53A and the right-side plate 54A (FIG. 7A, FIG. 7B, FIG. 8A, and FIG. 8B). However, the present invention is not limited thereto, and for example, similarly to the pawl bodies 43B, the left and right edges of the coupling plate 55A may be respectively connected to the left-side plate 53A and the right-side plate 54A at the upper side of the lower ends of the left-side plate 53A and the right-side plate 54A. Configuration may also be such that the guiding-side edge of the coupling plate 55A is not connected to the guide plate 51. Alternatively, plural of the coupling plates 55A may be provided at plural different locations of the pawl bodies 43A along the up-down direction. Alternatively, the coupling plate 55A may be omitted from the pawl bodies 43A. The same also applies to the pawl bodies 43B, 43C, as well as to the pawl bodies 73 and the like. In addition, the same also applies to the second exemplary embodiment.

Moreover, in the first exemplary embodiment above, explanation was given regarding a case in which the upper ends of the driving rollers 36 are disposed higher than the main body upper face portion 41T of the main body 41 in the front storage box conveyance guide 32, and the upper-end portions of the driving rollers 36 are interposed between the left-side plate 53B and the right-side plate 54B of the respective pawl bodies 43B (FIG. 9A, FIG. 9B). However, the present invention is not limited thereto, and in cases in which, for example, the gripping point spacing L2 (FIG. 11), which is the spacing between the gripping point P1 and the gripping point P2, is able to made comparatively long, the attachment position of the driving rollers 36 in the front storage box conveyance guide 32 may be lowered such that the upper ends of the driving rollers 36 are lower than the main body upper face portion 41T of the main body 41, namely are disposed below the pawl portion 42. In such a case, the respective pawl bodies 43 in the pawl portion 42 are able to be disposed without regard for the driving rollers 36, and so, by, for example, disposing as many as possible of only the pawl bodies 43C, which have the smallest pawl body width, in the pawl portion 42, the storage box guide faces 32S and the handover section guide faces 62S may be more smoothly connected together.

Moreover, in the first exemplary embodiment above, explanation was given regarding a case in which, when manufacturing the front storage box conveyance guide 32 by injection molding, a mold is employed that is split into a front and rear by a split line running along the up-down direction. However, the present invention is not limited thereto, and for example, manufacturing may be performed using a mold that is split by a split line running along various directions, such as an oblique direction linking a front upper-side and a rear lower-side of the mold. In such cases, the plate faces of the facing plate 52 and the coupling plate 55 may be formed not along the up-down direction, but along a direction orthogonal to the split line, namely along the direction in which the mold is removed from a manufactured front storage box conveyance guide 32. The direction of the split line in the mold may, for example, be determined as appropriate depending on, for example, the shapes of portions other than the pawl portion 42 in the front storage box conveyance guide 32. The same also applies to the rear storage box conveyance guide 33, the handover section conveyance guide group 61, and the like, as well as to the second exemplary embodiment.

Moreover, in the first exemplary embodiment above, explanation was given regarding a case in which the positions of the non-guiding side (namely, the rear side) edges of the facing plate 52, the left-side plate 53, the right-side plate 54, and the coupling plate 55 of each pawl body 43 of the front storage box conveyance guide 32 are aligned (FIG. 7A, FIG. 7B, FIG. 8A, and FIG. 8B). However, the present invention is not limited thereto. For example, similarly to the pawl bodies 43 (FIG. 5) of the rear storage box conveyance guide 33, the positions of the respective edges may be made to differ from each other, such as by positioning the non-guiding side edge of just the facing plate 52 further toward the guiding side. The same also applies to the second exemplary embodiment.

Moreover, in the first exemplary embodiment above, explanation was given regarding a case in which the flat-face shaped inclined face 51L is formed in the vicinity of the upper end of the guide plate 51 of each pawl body 43 in the front storage box conveyance guide 32, namely in the vicinity of a connection portion with the facing plate 52. However, the present invention is not limited thereto. For example, a curved face may be formed at the connection portion between the guide plate 51 and the facing plate 52, or the inclined face 51L may be omitted and the guide plate 51 and the facing plate 52 may be connected so as to meet at a right angle. In short, a banknote progressing along the conveyance path is preferably guided without becoming caught on the connection portions. The same also applies to the rear storage box conveyance guide 33, the handover section conveyance guide group 61, and the like, as well as to the second exemplary embodiment.

Moreover, in the first exemplary embodiment above, explanation was given regarding a case in which the placement, left-right direction lengths, and the like of the respective pawl bodies 43 of the front storage box conveyance guide 32 and the rear storage box conveyance guide 33, which guide banknotes conveyed along the up-down direction, are aligned such that interference with the respective pawl bodies 73 of the handover section conveyance guide group 61 is avoided when banknote storage boxes 26 mounted to the lower frame 17 move along the front-rear direction orthogonal to the conveyance direction. However, the present invention is not limited thereto. For example, in cases in which configuration is such that with respect to the handover section 28, banknote storage boxes 26 move along a direction following the conveyance direction of the banknotes, for example in a downward direction, the placement, left-right direction lengths, and the like of the respective pawl bodies 43 of the front storage box conveyance guide 32 may be made to differ from those of the rear storage box conveyance guide 33. The same also applies to the second exemplary embodiment, and in addition, the placement, left-right direction lengths and the like of the protective pawl bodies 143 may also be made to differ from those of the pawl bodies 43.

Moreover, in the first exemplary embodiment above, explanation was given regarding a case in which the pawl portion 42 of the front storage box conveyance guide 32 is provided with two of the pawl bodies 43A, two of the pawl bodies 43B, and a total of six pawl bodies 43C, with three of the pawl bodies 43C on each of the left and the right (FIG. 5 and FIG. 6). However, the present invention is not limited thereto, and configuration may be such that any freely selected number of each of the pawl bodies 43A, 43B, and 43C may be provided. Alternatively, pawl bodies 43 with different pawl body widths than the pawl bodies 43A, 43B, and 43C may be provided. In short, it is sufficient that each of the pawl bodies 43 include at least a guide plate 51, a facing plate 52, a left-side plate 53, and a right-side plate 54. Further, the heights of the pawl bodies 43, namely the lengths from the upper face of the main body 41 to the upper face of the facing plates 52, do not need to be uniform, and may be made different to each other. The same also applies to the pawl portion 42 of the rear storage box conveyance guide 33, the pawl portion 72 of the front handover section conveyance guide 62, and the like, and the same applies to the second exemplary embodiment.

Moreover, in the first exemplary embodiment above, explanation was given regarding a case in which the present invention is applied to upper ends of a storage box conveyance guide group 31 that guides banknotes in a banknote storage box 26 for storing the banknotes, namely, to pawl bodies 43 formed at a portion connected to a handover section conveyance guide group 61 of a handover section 28. However, the present invention is not limited thereto, and the present invention may be applied to conveyance guides provided to various locations in the banknote pay-in/pay-out device 10. In short, the present invention may be applied to cases in which pawl bodies are provided at the connection location of a conveyance guide at a location where, for maintenance purposes or the like, a conveyance path is permitted to be easily made or broken.

Moreover, in the first exemplary embodiment above, explanation was given regarding a case in which the vicinity of end portions at a non-guiding side (namely, rear side) of an upper face of the respective pawl bodies 43 of the rear storage box conveyance guide 33 are rounded, and in accordance therewith, the front-rear direction lengths of the facing plates 52 of each of the pawl bodies 43 are made shorter than those of the facing plates 52 on the front storage box conveyance guide 32 side. However, the present invention is not limited thereto. For example, configuration may be such that the pawl bodies 43 of the rear storage box conveyance guide 33 have front-rear symmetry with the respective pawl bodies 43 of the front storage box conveyance guide 32, and the rear sides of the upper faces of the respective pawl bodies 43 are not rounded. In such cases, the facing plate 52 can be configured longer in the front-rear direction, enabling the strength thereof to be further increased.

Moreover, in the first exemplary embodiment above, explanation was given regarding a case in which the present invention is applied to a pawl portion 42 of a storage box conveyance guide group 31 that guides banknotes, these being a paper sheet shaped medium, along a conveyance path, and the pawl portion 42 is provided at a connection portion with a handover section conveyance guide group 61 of a handover section 28. However, the present invention is not limited thereto. For example, the present invention may be applied to conveyance guides for guiding various media such as cash vouchers, securities, entrance tickets, or the like along a conveyance path. The shape of the medium is not limited to a paper sheet shape such as that of banknotes, and may be various shapes such as cuboidal shapes. The same also applies to the second exemplary embodiment.

The present invention is not limited to the respective exemplary embodiments and the other exemplary embodiments described above. Namely, the range of application of the present invention encompasses exemplary embodiments appropriately combining elements of some or all of the respective exemplary embodiments and the other exemplary embodiments described above, and embodiments deriving from elements thereof.

Moreover, in the first exemplary embodiment above, explanation was given regarding a case in which a front storage box conveyance guide 32 and a rear storage box conveyance guide 33 each serving as a conveyance guide are respectively configured by a main body 41 serving as a conveyance guide main body and a pawl portion 42 serving as a pawl portion, and in which pawl bodies 43 serving as a pawl bodies are each configured by a guide plate 51 serving as a guide plate, a facing plate 52 serving as a facing plate, and a left-side plate 53 and a right-side plate 54 serving as side plates. However, the present invention is not limited thereto, and the conveyance guide may be configured by a conveyance guide main body and a pawl portion of various other configurations, and the pawl bodies may be configured by a guide plate, a facing plate, and side plates of various other configurations.

Moreover, in the first exemplary embodiment above, explanation was given regarding a case in which a banknote storage box 26 serving as a medium storage box is configured by a storage box casing 26S serving as a storage casing, a main body 41 serving as a conveyance guide main body, and a pawl portion 42 serving as a pawl portion, and in which pawl bodies 43 serving as pawl bodies are each configured by a guide plate 51 serving as a guide plate, a facing plate 52 serving as a facing plate, and a left-side plate 53 and a right-side plate 54 serving as side plates. However, the present invention is not limited thereto, and the medium storage box may be configured by a storage casing, a conveyance guide main body, and a pawl portion of various other configurations, and the pawl bodies may be configured by a guide plate, a facing plate, and side plates of various other configurations.

Moreover, in the first exemplary embodiment above, explanation was given regarding a case in which an ATM 1 serving as a medium transaction device is configured by a casing 11 serving as a casing, a banknote storage box 26 serving as a medium storage box, and a handover section 28 serving as a handover section, in which the medium storage box is configured by a storage box casing 26S serving as a storage casing, a main body 41 serving as a conveyance guide main body, and a pawl portion 42 serving as a pawl portion, and in which pawl bodies 43 serving as pawl bodies are each configured by a guide plate 51 serving as a guide plate, a facing plate 52 serving as a facing plate, and a left-side plate 53 and a right-side plate 54 serving as side plates. However, the present invention is not limited thereto, and the medium transaction device may be configured by a casing, a medium storage box, and a handover section of various other configurations, the medium storage box may be configured by a storage casing, a conveyance guide main body, and a pawl portion of various other configurations, and the pawl bodies may be configured by a guide plate, a facing plate, and side plates of various other configurations.

INDUSTRIAL APPLICABILITY

The present invention may be employed in various devices such as, for example, ATMs, that are configured such that a storage box for storing a medium such as banknotes is attachable to and detachable from a casing, and when the storage box is mounted, in which medium handover between the storage box and casing is performed as the medium is guided by a conveyance guide.

The disclosure of Japanese Patent Application No. 2015-110264, filed May 29, 2015, is incorporated in its entirety by reference herein.

The invention claimed is:

1. A medium transaction device comprising:

a casing;

a medium storage box that stores a medium transacted with a user, and that attaches to and detaches from the casing;

a handover section that performs a handover of the medium with the medium storage box when the medium storage box is mounted to the casing; and a conveyance section that conveys the medium for handover with the handover section, and that includes a conveyance-section-side driving roller that abuts the medium at a predetermined conveyance-section-side drive force transmission point so as to transmit drive force to the medium, wherein:

the medium storage box comprises a conveyance guide main body that restricts a range of movement of a medium, which is to be handed over from a handover source to a handover counterparty, using a guide face so as to cause the medium to progress along a conveyance direction parallel to the guide face, a pawl portion that is disposed at a location on the conveyance guide main body facing the handover counterparty, and that is provided with a plurality of pawl bodies projecting out toward the handover counterparty at discrete locations along a width direction intersecting the conveyance direction and parallel to the guide face, each of the pawl bodies including a guide plate, a facing plate and two side plates, at least a portion of the guide plate forming the guide face, the facing plate being connected to an edge of the guide plate at a handover counterparty side of the guide plate so as to face the handover counterparty, the two side plates being each connected to respective width direction edges of the guide plate and the facing plate and to the conveyance guide main body, a storage-box-side driving roller that transmits drive force to the medium at a storage-box-side drive force transmission point, the distance from the conveyance-section-side drive force transmission point to the storage-box-side drive force transmission point being shorter than a length of the medium along the conveyance direction, and a through hole that penetrates a portion of the guide plate of the pawl body disposed at a conveyance direction side of the storage-box-side driving roller, and that exposes a portion of the storage-box-side driving roller at the guide face side of the conveyance guide main body.

2. The medium transaction device of claim 1, each of the pawl bodies further comprises a coupling plate that is provided at a location separated from the facing plate along a direction away from the handover counterparty and that couples the two side plates together.

3. The medium transaction device of claim 2, wherein an edge of the coupling plate, at a guide face side of the coupling plate, is connected to the guide plate.

4. The conveyance guide of claim 1, wherein, among the pawl bodies, a driving roller pawl body that is positioned at a handover counterparty side of the storage-box-side driving roller exposes a portion of the storage-box-side driving roller at a guide face side of the conveyance guide main body through the through hole penetrating the guide plate.

5. The medium transaction device of claim 4, wherein:

width direction lengths of the conveyance guide main body and the pawl portion are set to a conveyance width that is longer than the length of the medium; and in the pawl portion, two of the driving roller pawl bodies are disposed within the range of the conveyance width at locations separated from each other, two of the pawl bodies are disposed between the two driving roller pawl bodies, and three of the pawl bodies are disposed at an outer side of each of the two driving roller pawl bodies.

6. A medium transaction device comprising:

a casing;

a medium storage box that stores a medium transacted with a user, and that attaches to and detaches from the casing;

a handover section that performs a handover of the medium with the medium storage box when the medium storage box is mounted to the casing; and a conveyance section that conveys the medium for handover with the handover section, and that includes a conveyance-section-side driving roller that abuts the medium at a predetermined conveyance-section-side drive force transmission point so as to transmit drive force to the medium, wherein:

the medium storage box comprises a storage casing that internally stores the medium, a conveyance guide main body that is provided to the storage casing and that restricts a range of movement of the medium using a storage box guide face so as to cause the medium to progress along a conveyance direction parallel to the storage box guide face, a pawl portion that is provided with a plurality of pawl bodies projecting out toward the handover section at discrete locations along a width direction intersecting the conveyance direction parallel to the storage box guide face, each of the pawl bodies including a guide plate, a facing plate and two side plates, at least a portion of the guide plate forming the storage box guide face, the facing plate being connected to an edge of the guide plate at a handover section side of the guide plate so as to face the handover section, the two side plates being each connected to respective width direction edges of the guide plate and the facing plate and to the conveyance guide main body, a storage-box-side driving roller that transmits drive force to the medium at a storage-box-side drive force transmission point, the distance from the conveyance-section-side drive force transmission point to the storage-box-side drive force transmission point being shorter than a length of the medium along the conveyance direction, and a through hole that penetrates a portion of the guide plate of the pawl body disposed at a conveyance direction side of the storage-box-side driving roller, and that exposes a portion of the storage-box-side driving roller at the storage box guide face side of the conveyance guide main body, the handover section comprises a handover guide main body that restricts a range of movement of the medium using a handover section guide face contiguous to the storage box guide face of the medium storage box when the medium storage box is mounted to the casing so as to cause the medium to progress along a handover direction parallel to the handover section guide face, and a handover pawl portion that faces the medium storage box and that is provided with a plurality of handover pawl bodies projecting out toward the medium storage box at locations interlocking with the pawl bodies provided to the pawl portion of the medium storage box.

7. A medium transaction device, comprising:

a casing;

a medium storage box that stores a medium transacted with a user, and that attaches to and detaches from the casing;

a handover section that performs a handover of the medium with the medium storage box when the medium storage box is mounted to the casing; and a conveyance section that conveys the medium for handover with the handover section, and that includes a conveyance-section-side driving roller that abuts the medium at a predetermined conveyance-section-side drive force transmission point so as to transmit drive force to the medium, wherein:

the medium storage box comprises a conveyance guide main body that restricts a range of movement of a medium using a guide face so as to cause the medium to progress along a conveyance direction parallel to the guide face, a pawl portion that is provided with a plurality of pawl bodies at an edge of the conveyance guide main body and at discrete locations along a width direction intersecting the conveyance direction and parallel to the guide face, each of the pawl bodies including a guide plate, a facing plate and two side plates, at least a portion of the guide plate forming the storage box guide face, the facing plate being connected to the guide plate and formed at a location removed from the guide face, the two side plates being each connected to the guide plate, the facing plate and the conveyance guide main body and formed in a direction extending away from the guide face, a storage-box-side driving roller that transmits drive force to the medium at a storage-box-side drive force transmission point, the distance from the conveyance-section-side drive force transmission point to the storage-box-side drive force transmission point being shorter than a length of the medium along the conveyance direction, and a through hole that penetrates a portion of the guide plate of the pawl body disposed at a conveyance direction side of the storage-box-side driving roller, and that exposes a portion of the storage-box-side driving roller at the guide face side of the conveyance guide main body.

8. The medium transaction device of claim 7, wherein the two side plates are connected together with the conveyance guide main body or with a coupling plate that is provided at a location removed from the facing plate toward the conveyance guide main body.

9. A medium transaction device, comprising:

a casing;

a medium storage box that stores a medium transacted with a user, and that attaches to and detaches from the casing;

a handover section that performs a handover of the medium with the medium storage box when the medium storage box is mounted to the casing; and a conveyance section that conveys the medium for handover with the handover section, and that includes a conveyance-section-side driving roller that abuts the medium at a predetermined conveyance-section-side drive force transmission point so as to transmit drive force to the medium, wherein:

the medium storage box comprises a conveyance guide main body that causes a medium, which is to be handed over from a handover source to a handover counterparty, to progress along a conveyance direction, a pawl portion that is disposed at a location on the conveyance guide main body facing the handover counterparty, and that is provided with a plurality of pawl bodies projecting out toward the handover counterparty at discrete locations along a width direction intersecting the conveyance direction, each of the pawl bodies including a guide plate, a facing plate, two side plates and a coupling plate, the guide plate restricting a range of movement of the medium, the facing plate being provided at a location downstream from the conveyance guide main body in the conveyance direction and connected to an edge of the guide plate at a handover counterparty side of the guide plate so as to face the handover counterparty, the two side plates being each connected to respective width direction edges of the guide plate and the facing plate and to the conveyance guide main body, the coupling plate coupling the two side plates together, a storage-box-side driving roller that transmits drive force to the medium at a storage-box-side drive force transmission point, the distance from the conveyance-section-side drive force transmission point to the storage-box-side drive force transmission point being shorter than a length of the medium along the conveyance direction, and a through hole that penetrates a portion of the guide plate of the pawl body disposed at a conveyance direction side of the storage-box-side driving roller, and that exposes a portion of the storage-box-side driving roller at the guide face side of the conveyance guide main body.

* * * * *